US010196778B2

(12) United States Patent
Sebastian et al.

(10) Patent No.: US 10,196,778 B2
(45) Date of Patent: Feb. 5, 2019

(54) TOBACCO-DERIVED NANOCELLULOSE MATERIAL

(71) Applicant: R.J. Reynolds Tobacco Company, Winston-Salem, NC (US)

(72) Inventors: Andries Don Sebastian, Clemmons, NC (US); Samuel Mark DeBusk, Lexington, NC (US); David Neil McClanahan, Winston-Salem, NC (US); Panu Lahtinen, Jaervenpaeae (FI); Marjo Maeaettaenen, Kerava (FI); Airi Saerkilahti, Lohja (FI)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 15/463,882

(22) Filed: Mar. 20, 2017

(65) Prior Publication Data

US 2018/0266053 A1 Sep. 20, 2018

(51) Int. Cl.

| | |
|---|---|
| ***D21H 11/12*** | (2006.01) |
| ***D21H 11/18*** | (2006.01) |
| ***D21C 3/00*** | (2006.01) |
| ***D21C 5/00*** | (2006.01) |
| ***D21B 1/04*** | (2006.01) |
| *A24B 5/16* | (2006.01) |

(52) U.S. Cl.

CPC ..... *D21H 11/12* (2013.01); *D21B 1/04* (2013.01); *D21C 3/003* (2013.01); *D21C 5/005* (2013.01); *D21H 11/18* (2013.01); *A24B 5/16* (2013.01)

(58) Field of Classification Search

USPC ..... 162/139, 231; 131/365

See application file for complete search history.

(56) References Cited

U.S. PATENT DOCUMENTS

| | | | | |
|---|---|---|---|---|
| 787,611 | A | 4/1905 | Daniels, Jr. | |
| 1,086,306 | A | 2/1914 | Oelenheinz | |
| 1,437,095 | A | 11/1922 | Delling | |
| 1,757,477 | A | 5/1930 | Rosenhoch | |
| 2,122,421 | A | 7/1938 | Hawkinson | |
| 2,148,147 | A | 2/1939 | Baier | |
| 2,170,107 | A | 8/1939 | Baier | |
| 2,274,649 | A | 3/1942 | Baier | |
| 2,770,239 | A | 11/1956 | Prats et al. | |
| 3,126,010 | A * | 3/1964 | Makovka | D21H 5/16 131/358 |
| 3,612,065 | A | 10/1971 | Rosen | |
| 3,851,653 | A | 12/1974 | Rosen | |
| 3,889,689 | A | 6/1975 | Rosen | |
| 4,143,666 | A | 3/1979 | Rainer et al. | |
| 4,194,514 | A | 3/1980 | Campbell | |
| 4,306,578 | A * | 12/1981 | Schmidt | A24B 15/30 131/353 |
| 4,366,824 | A | 1/1983 | Rainer et al. | |
| 4,388,933 | A | 6/1983 | Rainer et al. | |
| 4,511,433 | A | 4/1985 | Tournier et al. | |
| 4,641,667 | A | 2/1987 | Schmekel et al. | |
| 5,091,054 | A | 2/1992 | Meier et al. | |
| 5,246,543 | A | 9/1993 | Meier et al. | |
| 6,007,678 | A | 12/1999 | Linsten et al. | |
| 6,019,870 | A | 2/2000 | Devic et al. | |
| 6,165,318 | A | 12/2000 | Paren et al. | |
| 6,214,164 | B1 | 4/2001 | Rantala | |
| 6,398,908 | B1 | 6/2002 | Hermansson et al. | |
| 6,772,767 | B2 | 8/2004 | Mua et al. | |
| 6,824,645 | B2 | 11/2004 | Jaschinski et al. | |
| 6,923,887 | B2 | 8/2005 | Pan | |
| 9,339,058 | B2 | 5/2016 | Byrd, Jr. et al. | |
| 2004/0231060 | A1 | 11/2004 | Burdette et al. | |
| 2008/0196847 | A1 | 8/2008 | Pieter van Heiningen et al. | |
| 2009/0090478 | A1 | 4/2009 | Hollomon et al. | |

(Continued)

FOREIGN PATENT DOCUMENTS

| | | |
|---|---|---|
| CN | 102669809 | 9/2012 |
| WO | WO 96/31255 | 10/1996 |

(Continued)

OTHER PUBLICATIONS

Torvinen et al. , Smooth and flexible filler—nanocellulose composite structure for printed electronics applications, Cellulose, 2012, pp. 821-829.*

Dufrense, et al., "Nanocellulose: a new ageless bio nanomaterial," Materials Today, 2013, vol. 16(6), pp. 220-227.

Gao, et al., "Effect of beating on tobacco stalk mechanical pulp," *Cellulose chemistry and technology*, 2012, pp. 277-282, vol. 46(3-4).

Kajit, et al., "Improvement in pulping and bleaching properties of xylem from transgenic tobacco plants," *Journal of the Science of Food and Agriculture*, 2002, pp. 1216-1223, vol. 82(10).

Kimura, et al., "Studies on the manufacture of tobacco stem pulp II—Pulping of tobacco stem with alkalies (Japanese language)," *Japan Tappi Journal*, 1962, pp. 978-984, vol. 16(12).

Missoum, et al., "Nanofibrillated Cellulose surface Modifications: A Review," *Materials*, 2013, vol. 6, pp. 1745-1766.

(Continued)

*Primary Examiner* — Mark Halpern

(74) *Attorney, Agent, or Firm* — Womble Bond Dickinson (US) LLP

(57) ABSTRACT

The present disclosure relates to cellulose nanomaterials made or derived from tobacco and methods for the production thereof. The tobacco-derived cellulose nanomaterials can be employed in various industrial applications such as film forming applications and solution thickening technologies. In particular, the disclosure is directed to methods for preparing tobacco-derived cellulose nanomaterials using less fibrillation cycles than in the production of wood pulp. The invention includes a method for preparing tobacco derived nanocellulose material comprising receiving a tobacco pulp in a dilute form such that the tobacco pulp is a tobacco pulp suspension with a consistency of less than about 5%; and mechanically fibrillating the tobacco pulp suspension to generate a tobacco derived nanocellulose material having at least one average particle size dimension in the range of about 1 nm to about 100 nm.

24 Claims, 15 Drawing Sheets

(56) References Cited

U.S. PATENT DOCUMENTS

| | | | | |
|---|---|---|---|---|
| 2010/0036113 | A1 | 2/2010 | Mambrim Filho et al. | |
| 2010/0249390 | A1 | 9/2010 | Azuma et al. | |
| 2012/0211016 | A1 | 8/2012 | Byrd, Jr. et al. | |
| 2013/0276801 | A1 | 10/2013 | Byrd, Jr. et al. | |
| 2014/0227161 | A1 | 8/2014 | Manesh et al. | |
| 2014/0255688 | A1 | 9/2014 | Salminen et al. | |
| 2014/0326422 | A1 | 11/2014 | Fallon et al. | |
| 2015/0107790 | A1 | 4/2015 | Sixta et al. | |
| 2016/0186376 | A1 | 6/2016 | Nuopponen et al. | |
| 2016/0208440 | A1 | 7/2016 | Byrd, Jr. et al. | |
| 2017/0027220 | A1* | 2/2017 | Sebastian | A24F 15/18 |
| 2017/0291757 | A1* | 10/2017 | Sebastian | B65D 85/1081 |

FOREIGN PATENT DOCUMENTS

| | | | |
|---|---|---|---|
| WO | 2016013946 | A1 | 1/2016 |
| WO | 2016067226 | A1 | 5/2016 |

OTHER PUBLICATIONS

Mohta, D., et al., "Production of Refiner Mechanical Pulp From Kenaf for Newsprint in Developing Countries," TAPPI Journal, 2004, vol. 3(4).

Peng, et al., "Chemistry and Applications of nanocrystalline cellulose and its derivatives: A nanotechnology perspective," *Canadian Journal of Chemical Engineering*, 2011, vol. 9999, pp. 1-16.

Ralph et al., "NMR Characterization of Altered Lignings Extracted from Tobacco Plants Down-Regulated for Lignification Enzymes Cinnamyl-Alcohol Dehydrogenase and Cinnamoyl-CoA Reductase" *Proceedings of the National Academy of Sciences*, 1998, vol. 95, pp. 12803-12808. http://www.ncbi.nlm.nih.gov/pmc/articles/PMC23601/.

Sabharwal, H.S., et al., "Refiner Mechanical and Biomechanical Pulping of Jute," Holzforschung, 1995, pp. 537-544, vol. 49.

Wu, G., et al., "Improved Alkaline Oxidation Process for the Production of Aldehydes (Vanillin and Syringaldehyde) from Steam-Explosion Hardwood Lignin," Industrial & Engineering Chemistry Research, 1994, pp. 718-723, vol. 33.

Zhang, Yi-Heng Percival et al., Toward an Aggregated Understanding of Enzymatic Hydrolysis of Cellulose: Noncomplexed Cellulase Systems. Wiley InterScience. Biotechnology and Bioengineering, vol. 88, No. 7, Dec. 30, 2004, p. 797-824.

Ziaie-Shirkolaee et al. "Study on Cellulose Degradation During Organosolv Delignification of Wheat Straw and Evaluation of Pulp Properties," *Iranian Polymer Journal*, 2007, pp. 83-96, vol. 16, (2).

Paakko et al: "Enzymatic Hydrolysis Combined with Mechanical Shearing and High-Pressure Homogenization for Nanoscale Cellulose Fibrils and Strong Gels", Biomacromolecules, American Chemical Society, US, vol. 8, Jan. 1, 2007 (Jan. 1, 2007), pp. 1934-1941.

Tuzzin et al: "Nanofibrillated cellulose from tobacco industry wastes", Carbohydrate Polymers, Applied Science Publishers, Ltd. Barking, GB, vol. 148, Apr. 12, 2016, pp. 69-77.

Qing et al: "A comparative study of cellulose nanofibrils disintegrated via multiple processing approaches", Carbohydrate Polymers, Applied Science Publishers, Ltd. Barking, GB, vol. 97, No. 1, May 4, 2013, pp. 226-234.

Garcia et al: "Industrial and crop wastes: A new source for nanocellulose biorefinery", Industrial Crops and Products, Elsevier, NL, vol. 93, Jun. 21, 2016, pp. 26-38.

Osterberg et al, "A Fast Method to Produce Strong NFC Films as a Platform for Barrier and Functional Materials," ACS Appl. Mater. Interfaces 2013, 5, pp. 4640-4647.

Henrikson et al, "Cellulose Nanopaper Structures of High Toughness," Biomacromolecules 2008, 9, pp. 1579-1585.

Lavoine et al, "Microfibrillated cellulose—its barrier properties and applications in cellulosic materials: a review," J. Carbohydr. Polym. 2012, 90, pp. 735-764.

International Search Report for PCT/IB2018/051839 dated Jun. 12, 2018.

* cited by examiner

TOBACCO-DERIVED NANOCELLULOSE MATERIAL

FIELD OF THE DISCLOSURE

The present disclosure relates to products made or derived from tobacco and methods for the production thereof. The tobacco-derived products can be employed in various industrial applications such as film forming applications and solution thickening technologies.

BACKGROUND OF THE DISCLOSURE

Cellulose nanomaterials are isolated from trees, plants, and algae or can be generated by bacteria. Different raw material sources, as well as different production methods, will lead to cellulose nanomaterials with differing morphology and properties, such as length, aspect ratio, branching and crystallinity. With respect to commercialization, two major categories of cellulose nanomaterials have received the greatest interest: cellulose nanocrystals (CNCs) and cellulose nanofibrils (CNFs). CNCs and CNFs are obtained from a variety of cellulose sources, such as wood, using various processing methods. For example, CNCs are produced by acid hydrolysis of wood fiber, whereas CNFs are produced using mechanical processes with or without pre-treatment procedures requiring chemicals or biological treatments to produce fibril-like nanoscale materials. The ability to produce such a wide range of cellulose nanomaterials with different morphologies and properties represents a whole variety of potential applications across multiple industries.

However, the production of cellulose nanomaterials is time and energy consuming. The production of native grades usually requires multiple cycles in the fibrillation stage when commercial mill pulp is used. The degree of fibrillation can be affected by the selection of pre-treatments and choice of raw materials. Currently, the most common raw material is wood pulp, which forms a viscous hydrogel after multiple passes in a grinder or high pressure homogenizer. Since the fibrillation time is the most significant cost factor in the production of cellulose nanomaterials, there is a great need to develop processing methods with a reduced number of fibrillation cycles. In addition, there is a need in the art for more biomaterials as potential sources for raw materials in the production of cellulose nanomaterials, which require production processes that are more cost efficient.

BRIEF SUMMARY OF THE DISCLOSURE

The present invention provides the preparation of tobacco-derived pulp, which can be further treated to generate various nanocellulose materials such as cellulose nanocrystals (CNC) and cellulose nanofibrils (CNF). Whereas current procedures using wood pulp as a starting biomaterial require a large amount of energy due to the numerous cycles of fibrillation required to produce nanocellulose based materials, in certain embodiments, the current invention provides a procedure that requires a significantly lower amount of energy (and lower number of fibrillation cycles) to produce tobacco-derived nanocellulose materials. These nanocellulose based materials exhibit numerous interesting properties including film forming ability and rheological properties as will be presented in the following embodiments.

In one aspect, the invention is directed to a method for preparing tobacco-derived nanocellulose material comprising: receiving a tobacco pulp in a dilute form such that the tobacco pulp is a tobacco pulp suspension with a consistency of less than about 5%; and mechanically fibrillating the tobacco pulp suspension to generate a tobacco derived nanocellulose material having at least one average particle size dimension in the range of about 1 nm to about 100 nm. In some embodiments, the tobacco pulp is derived from tobacco root, tobacco stalk, tobacco fiber or a combination thereof. In some embodiments, the tobacco derived nanocellulose material comprises cellulose microfibrils, cellulose nanofibrils, or cellulose nanocrystals. In some embodiments, the tobacco derived nanocellulose material has an apparent viscosity of at least about 20,000 mPa*s at a consistency of 1.5%. In some embodiments, the tobacco derived nanocellulose material has an apparent viscosity of at least about 25,000 mPa*s at a consistency of 1.5%.

In some embodiments, the mechanically fibrillating step comprises one or more of homogenization, microfluidization, grinding, and cryocrushing. In some embodiments, the mechanically fibrillating step comprises passing the tobacco pulp suspension through a homogenizer or microfluidizer at elevated pressure of at least 100 bar. In some embodiments, the elevated pressure is at least 1000 bar. In some embodiments, the tobacco pulp suspension passes through the homogenizer or microfluidizer no more than 5 passes. In some embodiments, the tobacco pulp suspension passes through the homogenizer or microfluidizer no more than 3 passes. In some embodiments, the tobacco pulp suspension passes through the homogenizer or microfluidizer in only one pass.

In some embodiments, the method further comprises pre-treating the tobacco pulp, either before or after formation of the tobacco pulp suspension, by subjecting the tobacco pulp to one or more mechanical, chemical or enzymatic treatment steps. In some embodiments, the pre-treatment step is a mechanical grinding step. In some embodiments, the pre-treatment step comprises a chemical treatment step selected from TEMPO oxidation, peroxide oxidation, carboxymethylation, acetylation, acid hydrolysis, and combinations thereof. In some embodiments, the pre-treatment step comprises an enzymatic treatment selected from treatment with an endoglucanase, treatment with a hemicellulase, and combinations thereof.

Another aspect of the invention is directed to a film formed of a tobacco-derived nanocellulose material having at least one average particle size dimension in the range of about 1 nm to about 100 nm. In some embodiments, the tobacco-derived nanocellulose material is derived from tobacco root, tobacco stalk, tobacco fiber or a combination thereof. In some embodiments, the tobacco-derived nanocellulose material comprises cellulose microfibrils, cellulose nanofibrils, or cellulose nanocrystals. In some embodiments, the tensile strength of the film is greater than about 120 Mpa. In some embodiments, the tensile strength of the film is greater than about 130 Mpa. In some embodiments, the tensile strength of the film is or greater than about 140 Mpa.

In some embodiments, the film has one or more of: (a) a strain of at least about 11%; and (b) a tensile modulus of at least about 4 Gpa. In some embodiments, the oxygen permeability of the film is at least one of: (a) less than 0.2 cc×mm/$m^2$×day at a temperature of 23° C. and at a relative humidity (RH) of 0%; and (b) less than about 20 cc×mm/$m^2$×day at a temperature of 23° C. and at a relative humidity (RH) of 80%. In some embodiments, the water vapor permeability of the film is less than about 30 g×mm/$m^2$×day at a temperature of 23° C. and at a relative humidity (RH) of 50%. In some embodiments, the tobacco-derived nanocellulose material is cellulose nanofibrils having a surface chemically modified by addition of hydrophobic, hydrophilic, or polar functional groups to that surface.

BRIEF DESCRIPTION OF THE DRAWINGS

In order to assist the understanding of embodiments of the disclosure, reference will now be made to the appended drawings, which are not necessarily drawn to scale. The drawings are exemplary only, and should not be construed as limiting the disclosure.

DETAILED DESCRIPTION

Figure 1:
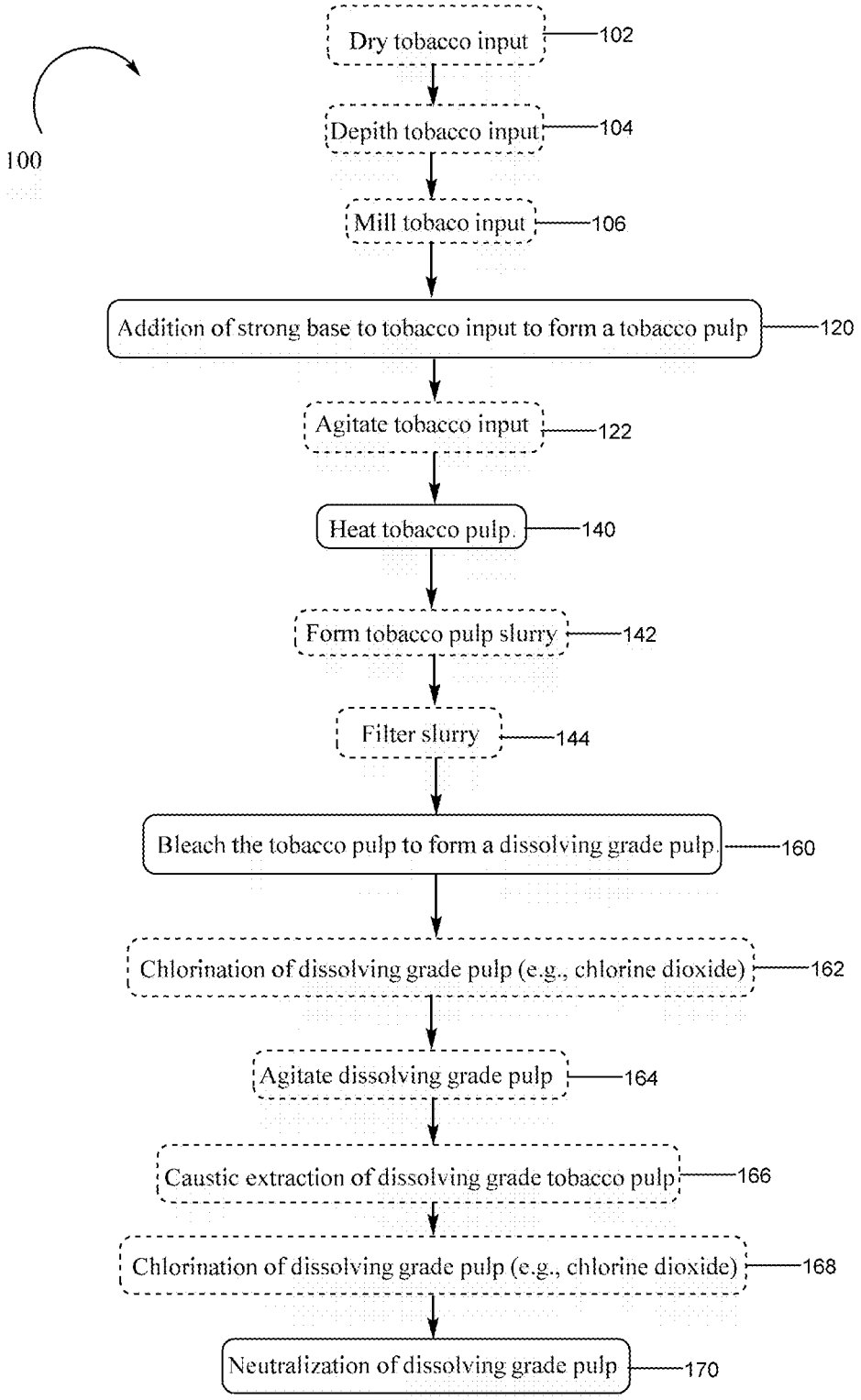
FIG. 1 is a diagram showing the individual steps of a process, which makes tobacco pulp, wherein the dashed boxes represent optional steps in the process.

The present disclosure now will be described more fully hereinafter with reference to the accompanying drawings. The disclosure can be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural references unless the context clearly dictates otherwise.

The present disclosure provides methods for forming nanocellulose materials from tobacco pulp formed from the stalk and/or root and/or fiber of a plant of the *Nicotiana* species. These components of the tobacco plant are commonly viewed as waste material and therefore the current methods and resulting tobacco-derived materials were developed to take advantage of such tobacco biomass by-products. The current methods for generating tobacco pulp generally comprises heating the tobacco material in a strong base to separate the undesired components such as hemicelluloses and lignin present in the tobacco raw material (i.e., stalk, root, fiber) from cellulose; and filtering the resulting mixture to obtain the desired cellulose material with the least amount of impurities. In several embodiments, the process can further include additional processing steps such as bleaching and extraction methods. The resulting tobacco pulp can be further modified to produce numerous nanocellulose materials such as cellulose nanofibrils (CNF), cellulose nanocrystals (CNC), and cellulose microfibrils (CMF), differing from each other mainly based on their isolation methods from the tobacco pulp. Each cellulose-based particle is distinct in terms of having a characteristic size, aspect ratio, morphology, and crystallinity. In general terms, the nanocellulose materials of the present invention will typically comprise materials where particles (whether unbound or as part of an aggregate or agglomerate) within a given particle distribution exhibit at least one average particle size dimension in the range of about 1 nm to about 100 nm.

In some embodiments, the tobacco-derived nanocellulose material comprises CNF. CNF particles are fine cellulose fibrils produced when techniques to facilitate fibrillation are incorporated into the mechanical refining of tobacco pulp. In some embodiments, the average length of a CNF particle ranges from about 0.5 to about 5 μm, or from about 0.5 to about 2 μm. In some embodiments, the average width of the CNF particles ranges from about 1 to about 30 nm or from about 4 to about 20 nm. In one embodiments, the average height of the CNF particles ranges from about 1 to about 30 nm, or from about 4 to about 20 nm. In some embodiments, the aspect ratio of the CNF particles ranges from about 1:1 to about 1:30. In some embodiments, the CNF particles comprise amorphous regions, crystalline regions or combinations thereof.

In some embodiments, the tobacco-derived nanocellulose material comprises CNC. CNC are particles remaining after acid hydrolysis of CMF or CNF particles. In some embodiments, the average length of a CNC particle ranges from about 0.05 to about 1 μm, or from about 0.05 to about 0.5 μm. In some embodiments, the average width of the CNC particles ranges from about 1 to about 10 nm, or from about 3 to about 5 nm. In some embodiments, the average height of the CNC particles ranges from about 1 to about 100 nm, or from about 3 to about 5 nm. In some embodiments, the CNC particles comprise crystallinity from about 50 to about 95% based on the crystallinity relative to cellulose. In some embodiments, the aspect ratio ranges from about 1:10 to about 1:100.

In some embodiments, the tobacco-derived nanocellulose material comprises CMF. CMF is generally produced via mechanical refining of tobacco pulp. In some embodiments, the average length of a CMF particle ranges from about 0.5 to about 100 μm, or from about 1 to about 10 μm. In some embodiments, the average width of the CMF particle ranges from about 10 to about 100 nm, or from about 30 to about 60 nm. In one embodiment, the average height of the CMF particle ranges from about 10 to about 100 nm. In some embodiments, the CMF particle comprises a crystallinity ranging from about 50 to about 75% based on the crystallinity relative to cellulose.

In some embodiments, the nanocellulose material comprises an apparent viscosity ranging from about 5,000 to about 40,000 mPa*s, preferably from about 20,000 to about 35,000 mPa*s, more preferably from about 20,000 to about 30,000 mPa*s at a consistency of 1.5%. In certain embodiments, the tobacco-derived nanocellulose material of the invention exhibits an apparent viscosity of at least about 20,000 mPa*s or at least about 25,000 mPa*s at a consistency of 1.5%. For example, in some embodiments, the nanocellulose material derived from pulp made from tobacco stalk comprises an apparent viscosity ranging from about 20,000 to about 30,000 mPa*s at a consistency of 1.5%. In some embodiments, the nanocellulose material derived from pulp made from tobacco fiber comprises an apparent viscosity ranging from about 5,000 to about 10,000 mPa*s at a consistency of 1.5%. In some embodiments, the nanocellulose material derived from pulp made from unbleached stalk comprises an apparent viscosity ranging from about 5,000 to about 15,000 mPa*s at a consistency of 1.5%. In some embodiments, the nanocellulose material derived from pulp made from root comprises an apparent viscosity ranging from about 25,000 to about 35,000 mPa*s at a consistency of 1.5%. In some embodiments, the nanocellulose material derived from pulp was ion-exchanged into its sodium form prior to fibrillation comprises an apparent viscosity ranging from about 20 000 to about 40 000 mPa*s at a consistency of 1.5%. For preparation of ion-exchanged pulp see Lahtinen et al., BioResources, 9(2) pages 2155-2127 (2014), which is incorporated by reference in its entirety.

Method of Making Tobacco Nanocellulose Material

The preparation of a tobacco material according to the present invention can comprise harvesting a plant from the *Nicotiana* species and, in certain embodiments, separating certain components from the plant such as the stalks, leaves and/or roots, and physically processing these components. Although whole tobacco plants or any component thereof (e.g., leaves, flowers, stems, roots, stalks, and the like) could be used as a potential source for tobacco input material, the use of stalks, and/or roots, and/or isolated fibers of the tobacco plant is preferred. In some embodiments, root and/or stalk may be preferred over some fiber material due to lower overall ash content and consequently a lower metal content.

The tobacco stalks and/or roots can be separated into individual pieces (e.g., roots separated from stalks, and/or root parts separated from each other, such as big root, mid root, and small root parts) or the stalks and/or roots may be combined. Likewise, tobacco fibers may be obtained using any part of the tobacco plant to isolate tobacco fibers, which can be used individually as a tobacco input material or may be used in combination with tobacco stalks and/or roots. For example, tobacco fibers can be obtained from tobacco stalk, tobacco root, tobacco midrib (stem), or a combination thereof. By "stalk" is meant the stalk that is left after the leaf (including stem and lamina) has been removed. "Root" and various specific root parts useful according to the present invention may be defined and classified as described, for example, in Mauseth, Botany: An Introduction to Plant Biology: Fourth Edition, Jones and Bartlett Publishers (2009) and Glimn-Lacy et al., Botany Illustrated, Second Edition, Springer (2006), which are incorporated herein by reference. Fiber can be obtained from several portions of the plant, e.g., the leaves, midrib (stem), and/or stalks. The harvested stalks, fibers and/or roots are typically cleaned, ground, and dried to produce a material that can be described as particulate (i.e., shredded, pulverized, ground, granulated, or powdered).

The manner by which the stalks, fibers and/or roots are provided can vary. For example, material obtained from *Nicotiana* plant stalks can be isolated and treated separately from material obtained from *Nicotiana* plant roots or material obtained from *Nicotiana* plant leaves. In addition, material from various parts of the stalks and/or roots can be isolated and treated separately. In some embodiments, material from different parts of the *Nicotiana* plant can be combined and processed together, thereby forming a single homogenous tobacco input material. In some embodiments, material from different parts of the *Nicotiana* plant are isolated and treated separately and can be optionally combined at some stage of the processing to give a single tobacco input product.

Preferably, the physical processing step comprises comminuting, grinding, and/or pulverizing parts of the *Nicotiana* plant (i.e., stalks, fibers and/or roots) into particulate form using equipment and techniques for grinding, milling, or the like. In such embodiments, equipment such as hammer mills, cutter heads, air control mills, or the like may be used.

The tobacco material provided following the comminuting, grinding, and/or pulverizing of *Nicotiana* stalks, fibers and/or roots can have any size. The tobacco material can be such that parts or pieces thereof have an average width and/or length between about 2 mm to about 5 cm, about 2 mm to about 2 cm, or about 2 mm to about 6 mm. In some embodiments, the average width and/or length of the tobacco input material is between about 2 mm to about 10 cm, or greater than or equal to about 2 mm, greater than or equal to about 6 mm, greater than or equal to about 1 cm, or greater than or equal to about 5 cm with an upper boundary of about 10 cm.

The selection of the types of tobacco or tobaccos utilized in the tobacco input material for the preparation of nanocellulose material can vary. The type of tobacco used as the source of tobacco stalks and/or roots from which the tobacco material is derived can vary. Tobaccos that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and Galpao tobaccos), Indian air cured, Red Russian and Rustica tobaccos, as well as various other rare or specialty tobaccos. Descriptions of various types of tobaccos, growing practices and harvesting practices are set forth in *Tobacco Production, Chemistry and Technology*, Davis et al. (Eds.) (1999), which is incorporated herein by reference. Various representative types of plants from the *Nicotiana* species are set forth in Goodspeed, *The Genus Nicotiana*, (Chonica Botanica) (1954); U.S. Pat. No. 4,660,577 to Sensabaugh, Jr. et al.; U.S. Pat. No. 5,387,416 to White et al. and U.S. Pat. No. 7,025,066 to Lawson et al.; US Patent Appl. Pub. Nos. 2006/0037623 to Lawrence, Jr. and 2008/0245377 to Marshall et al.; each of which is incorporated herein by reference.

The composition of sugar-based components present in the tobacco input material can vary and is based on the relative amounts of tobacco plant components (e.g., leaves, flowers, stems, roots, stalks, fibers) and/or the selection of the types of tobaccos utilized in the input material. The main sugar-based component required for the preparation of nanocellulose material is cellulose. Cellulose is a polysaccharide present as the primary component in most plant and tree cell walls providing structural rigidity of stem and leaves. Biomaterials containing high amounts of cellulose are desirable raw starting materials for the isolation of nanocellulose materials. In some embodiments, the amount of cellulose present in the tobacco material can range from about 30% to about 40%, preferably from about 32% to about 37% by weight based on the weight of the total tobacco input material. Besides cellulose, the tobacco input material also comprises additional sugar-based components and non-sugar based chemicals such as proteins and extractables.

In some embodiments, another sugar-based component often present in plant cells is lignin. Lignin is particularly important in the formation of cell walls, especially in wood and bark, because they also lend rigidity just like cellulose. Typically, the amount of lignin present depends on the source of the raw biomaterial selected. Therefore, starting biomaterials having a low amount of lignin present are preferred. In some embodiments, the amount of lignin present in the tobacco material can range from about 1% to about 10%, preferably from about 5% to about 8% by weight based on the total weight of the tobacco input material.

In some embodiments, hemicellulose and additional sugar-based components such as polysaccharides are also often present in starting biomaterials such as tobacco input materials. Examples include xylan, glucuronoxylan, arabinoxylan, galactoglucomannan (GGM), and xyloglucan. Hemicelluloses also need to be removed during the pulping process when isolating cellulose. In some embodiments, the amount of GGM present in the tobacco input material ranges from about 2 to about 7%, preferably from about 2.5 to about 6% by weight based on the total amount of tobacco input material. In some embodiments, the amount of xylan present in the tobacco input material ranges from about 8% to about 17.5% preferably from about 8% to about 12.5% by weight based on the total weight of the tobacco input material.

In further embodiments, proteins are present in the starting biomaterial (such as tobacco input material). Examples of proteins in plants include alpha-casein, gliadin, edestin, collagen, keratin, and myosin. In some embodiments, the amount of protein present in tobacco input material ranges from about 5% to about 9%, preferably from about 5% to about 7.5% by weight based on the total amount of tobacco input material.

In some embodiments, soluble materials or extractives are present in starting raw biomaterials, which are often soluble in organic solvents (polar and non-polar) and can be removed via extraction methods known in the art. Water soluble and volatile extractives are removed during pulping. Raw starting biomaterials with a low amount of extractives are desirable in the pulping process of producing nanocellulose materials. As used herein, tobacco stalks, fibers, and/or roots can undergo an extraction process to remove mainly organic soluble materials (e.g. extractives). The material remaining after tobacco stalks, fiber, and/or root materials undergo such an extraction process is useful in the subsequent pulping process. In some embodiments, the amount of extractives present in the tobacco input material ranges from about 0.5 to about 2.5%, preferably from about 0.9 to about 2.1% by weight based on the total amount of tobacco input material. In some embodiments, the extractives were removed using heptane, a non-polar organic solvent.

The tobacco input material can further comprise various elements from the Periodic Table. Such an elemental composition of the tobacco input material can also vary depending on the content of the tobacco input material. For example, the elemental composition may depend, in part, on whether the tobacco input material is prepared from *Nicotiana* stalks, roots, fibers or a combination thereof. Tobacco input material prepared solely from material obtained from *Nicotiana* stalks may exhibit a different elemental composition than tobacco input material prepared solely from material obtained from *Nicotiana* roots. As such, in some embodiments, the elemental composition of tobacco root, tobacco stalk, and tobacco fiber are not the same. For example, the elemental composition of tobacco fiber in certain embodiments is approximately: 5% Ash (525° C.), 3.8% Ash (9001° C.), 310 mg/kg Al, 15 g/kg Ca, 7.6 mg/kg Cu, 280 mg/kg Fe, 1.2 g/kg Mg, 48 mg/kg Mn, 480 mg/kg Si, 33 mg/kg Na, 1.2 g/kg S, <0.02 g/Kg Cl, and 3.2 g/kg K. The elemental composition of stalk is 3% Ash (525° C.), 2.3% Ash (900° C.), 25 mg/kg Al, 4.1 g/kg Ca, 13 mg/kg Cu, 42 mg/kg Fe, 2.4 g/kg Mg, 22 mg/kg Mn, 17 mg/kg Si, 40 mg/kg Na, 1.6 g/kg S, 3.5 g/Kg Cl, and 15 g/kg K. The elemental composition of root is 2.7% Ash (525° C.), 2.1% Ash (900° C.), 150 mg/kg Al, 2.3 g/kg Ca, 9.4 mg/kg Cu, 100 mg/kg Fe, 1.0 g/kg Mg, 9.0 mg/kg Mn, 180 mg/kg Si, 97 mg/kg Na, 1.5 g/kg S, 3.0 g/Kg Cl, and 17 g/kg K.

The selection of the plant from the *Nicotiana* species utilized in as the tobacco input material used in the production of nanocellulose material can vary as mentioned in previous embodiments. The particular *Nicotiana* species of material used in the production of nanocellulose material can also vary. Of particular interest are *N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata*, and *N.* x *sanderae*. Also of interest are *N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. rustica, N. simulans, N. stocktonii, N. suaveolens, N. tabacum, N. umbratica, N. velutina*, and *N. wigandioides*. Other plants from the *Nicotiana* species include *N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. *Hersperis, N. pauciflora, N. petunioides, N. quadrivalvis, N. repanda, N. rotundifolia, N. solanifolia* and *N. spegazzinii*. The *Nicotiana* species can be derived using genetic-modification or crossbreeding techniques (e.g., tobacco plants can be genetically engineered or crossbred to increase or decrease production of certain components or to otherwise change certain characteristics or attributes). See, for example, the types of genetic modifications of plants set forth in U.S. Pat. No. 5,539,093 to Fitzmaurice et al.; U.S. Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al.; and U.S. Pat. No. 7,230,160 to Benning et al.; US Patent Appl. Pub. No. 2006/0236434 to Conkling et al.; and PCT WO 2008/103935 to Nielsen et al.

The plant component or components from the *Nicotiana* species can be employed in an immature form. That is, the plant can be harvested before the plant reaches a stage normally regarded as ripe or mature. As such, for example, the plant can be harvested when the tobacco plant is at the point of a sprout, is commencing leaf formation, is commencing flowering, or the like.

The plant components from the *Nicotiana* species can be employed in a mature form. That is, the plant can be harvested when that plant reaches a point that is traditionally viewed as being ripe, over-ripe or mature. As such, for example, through the use of tobacco harvesting techniques conventionally employed by farmers, Oriental tobacco plants can be harvested, burley tobacco plants can be harvested, or Virginia tobacco leaves can be harvested or primed by stalk position.

After harvest, the plant of the *Nicotiana* species, or portion thereof, can be used in a green form (e.g., tobacco can be used without being subjected to any curing process). For example, tobacco in green form can be frozen, freeze-dried, subjected to irradiation, yellowed, dried, cooked (e.g., roasted, fried or boiled), or otherwise subjected to storage or treatment for later use. Such tobacco also can be subjected to aging conditions.

In certain embodiments, the tobacco input used to form the tobacco pulp and, ultimately, the nanocellulose materials, is derived substantially from roots and/or stalks of a tobacco plant. For example, the tobacco input used to form the tobacco pulp can comprise at least 90% by dry weight of either roots or stalks or a combination of roots and stalks.

Production of tobacco pulp involves a number of operations such as cooking, bleaching, neutralizing, and isolating. The resulting tobacco pulp should comprise a sufficient percentage of cellulose in order to be useful as a starting material in the production of nanocellulose material. Typically, such pulp has an amount of cellulose ranging from about 55% to about 90% by weight based on the total weight of the pulp. On the contrary, the quantity of hemicelluloses (e.g., GGM, xylan and the like) in pulp is preferably low (e.g., from about 0.5% to about 10% by weight). Additionally, the quantity of lignin in pulp is also preferably low (e.g., from about 0% to about 1.0% by weight). Further characteristics of tobacco pulp may also include ash content (e.g., from about 0% to about 0.5% by weight), organic extractives (e.g., from about 0% to about 1.0% by weight), brightness (e.g., ranging from about 10 to about 90%), viscosity (e.g., from about 2 to about 30 cP), and kappa number (e.g., ranging from about 10 to about 90).

One aspect of the current disclosure involves production of tobacco pulp according to the methods described in U.S. Pat. No. 9,339,058 to Byrd, Jr. et al. and U.S. Patent Appl. Pub. No. 2016/0208440 to Byrd, Jr. et al., which are herein incorporated by reference in their entireties. For example, as illustrated in FIG. 1, in one embodiment the method 100 can comprise chemical pulping (e.g., soda pulping) a tobacco input to form a tobacco pulp. This process is also often referred to as the Kraft cooking process, which was initially used to obtain wood pulp and has been used with other bio starting materials. Briefly, chemical pulping at operation can comprise combining the tobacco input with a strong base (e.g., one or more of sodium hydroxide, potassium hydroxide, sodium carbonate, sodium bicarbonate, potassium carbonate, potassium bicarbonate, ammonium hydroxide, ammonium bicarbonate, and ammonium carbonate) at operation 120 and heating the tobacco input and the base at operation 140. Further, the method can include exposing the tobacco pulp to a bleaching agent at operation 160. Optionally, as indicated by boxes with dashed lines, bleaching the tobacco pulp at operation 160 can comprise chlorination of the tobacco pulp with a chlorine dioxide solution at operation 162 and caustic extraction of the tobacco pulp with a second strong base (e.g., one or more of sodium hydroxide, potassium hydroxide, sodium carbonate, sodium bicarbonate, potassium carbonate, potassium bicarbonate, ammonium hydroxide, ammonium bicarbonate, and ammonium carbonate) at operation 166. As used herein, a strong base refers to a basic chemical compound (or combination of such compounds) that is able to deprotonate very weak acids in an acid-base reaction. Note that the strong base employed in caustic extraction at operation 162 (the "second strong base") may or may not be the same as the strong base employed in chemical pulping at operation 120.

Accordingly, the method described above provides operations configured to produce dissolving grade pulp from tobacco. However, the method can include one or more additional operations in some embodiments. These optional operations are indicated by boxes defining dashed lines in FIG. 1.

In this regard, the method can further comprise drying the tobacco input at operation 102 prior to chemical pulping the tobacco input. Further, the method can include depithing the tobacco input at operation 104 prior to chemical pulping the tobacco input. Depithing, or decorticating the tobacco input at operation 104 can be conducted to remove pith (which comprises lignin) from the tobacco input manually, and thus reduce the amount of chemicals needed to delignify the tobacco input during the chemical pulping and bleaching operations 160. In some embodiment, tobacco input derived from tobacco stalk and/or fiber is depithed.

Additionally, the method can include milling the tobacco input at operation 106, which can be conducted prior to chemical pulping the tobacco input. Milling the tobacco input at operation 106 can be conducted after depithing the tobacco input at operation 104. In this regard, manual or mechanical removal of the pith can be relatively easier with larger pieces of the tobacco input, though the method can be conducted in other sequences in other embodiments. Milling the tobacco input into particles at operation 106 can be conducted to increase the surface area of the tobacco input such that the chemical pulping and bleaching operations can act upon the greater surface area to increase the efficacy thereof. In some embodiments, the diameter of the tobacco input particles ranges from about 2 mm to about 8 mm, preferably from about 2 mm to about 6 mm, most preferably from about 2 mm to about 4 mm.

As noted above, chemical pulping at operation can involve use of chemicals (see, e.g., operation 120 and heat (see, e.g., operation 140) to break down the lignin in the tobacco input, which binds the cellulose fibers together, without seriously degrading the cellulose fibers.

In some embodiments, the weight of the strong base can be greater than about 5%, greater than about 25%, or greater than about 40% of the weight of the tobacco input. In further embodiments, the weight of the strong base can be from about 5% to about 50% or from about 30% to about 40% of the weight of the tobacco input.

In some embodiments, the effective alkali charge (EA charge), which is the concentration of alkaline constituents present in the white liquor ranges from about 15 to about 30%, preferably, 18 to about 28%, most preferred from about 20 to about 25%.

As additionally noted above, chemically pulping the tobacco input can include heating the tobacco input and the strong base at operation 140. Heating the tobacco input and the strong base at operation 140 can be conducted to increase the efficacy of the chemical pulping operation. In this regard, an increase in either cooking temperature or time will result in an increased reaction rate (rate of lignin removal). To make calculations involving chemical pulping simpler, chemical pulping is herein discussed in terms of a parameter called the H-factor, which takes into account both the temperature and time of the chemical pulping operation. The equation for calculating an H-factor is provided below:

$$H=\int_0^t \exp(43.2-16115/T)dt, \quad \text{(Equation 1)}$$

wherein:

T=temperature (in Kelvin), and t=time (in minutes).

Thus, the H-factor refers to the area contained by a plot of reaction rate versus time. In some embodiments, heating the tobacco input and the base at operation 140 can be conducted with an H-factor ranging from about 300 to about 2,000, more preferably from about 400 to about 1,500, most preferably from about 400 to about 900 (or at least 400 or at least 600 or at least 1,000).

Further, in some embodiments the tobacco input and the strong base can be heated to a temperature ranging from about 100 to about 200° C., from about 120 to about 180° C., from about 140 to about 160° C., or from about 145 to about 155° C. The maximum temperature can be maintained for about 30 to about 150 minutes.

In some embodiments, the amount of time for chemical pulping at a given temperature ranges from about 30 minutes to about 120 minutes, or about 50 minutes to about 100 minutes.

In some embodiments chemical pulping a tobacco input can be considered "mild" when the strong base is provided in a weight ratio less than about 30% by weight of the tobacco input. Mild chemical pulping may be conducted with an H-factor less than about 900 in some embodiments. Chemical pulping a tobacco input may be considered "moderated" when the strong base is from about 30% to about 40% by weight. Moderate chemical pulping may be conducted with an H-factor from about 900 to about 1,100. Chemical pulping a tobacco input may be considered "harsh" when the strong base is greater than about 40% by weight. Harsh chemical pulping may be conducted, for example, with an H-factor greater than about 1,100. Various other H-factors, temperatures, and times can be employed in other embodiments, as discussed in greater detail below.

The conditions during chemical pulping can be further configured to in increase the rate of lignin removal. For example, chemical pulping the tobacco input can be conducted in a pressurized vessel in some embodiments. A positive pressure can increase chemical penetration into the tobacco input. Additionally, as illustrated at operation 122, the method can further comprise agitating the tobacco input. Agitating the tobacco input can increase and equalize exposure of each piece of the tobacco input to the chemicals employed in chemical pulping. Example embodiments of vessels that can be employed during chemical pulping include a rotary globe digester, a finger reactor with internal rotating tines, a stationary batch digester, a hot-blow stationary batch digester, an orbital globe digester, and a rotating digester. Accordingly, chemical pulping of the tobacco input can be conducted in a variety of configurations with a variety of parameters in order to reduce lignin content.

After chemical pulping, the method can also include bleaching the tobacco pulp to produce a dissolving grade pulp at operation 160. However, in some embodiments one or more operations can be conducted after the chemical pulping operation and before the bleaching operation 160. For example, in some embodiments the method can also include mixing water with the tobacco pulp to form a slurry at operation 142 and filtering the slurry with a filter such that a portion of the tobacco pulp is removed at operation 144. In some embodiments, the ratio of liquid to solid material ranges from about 1:10 to about 10:1, preferably 6:1. Mixing water with the tobacco pulp to form a slurry at operation 142 and filtering the slurry at operation 144 is conducted to remove some of the non-cellulosic materials, such as pith, parenchyma, and tissue from the tobacco pulp. In some embodiments the portion of the tobacco pulp that is removed in the filtering operation 144 can define a weight that is greater than about 5%, greater than about 15%, greater than about 25% (with an upper boundary of 100%), or less than about 30% (with a lower boundary of 0%), or from about 0% to about 30% of the weight of the tobacco pulp prior to filtering.

Next, the bleaching operation 160 can be conducted to remove the residual non-cellulosic materials left over after chemical pulping without damaging the cellulose. Exemplary processes for treating tobacco with bleaching agents are discussed, for example, in U.S. Pat. No. 787,611 to Daniels, Jr.; U.S. Pat. No. 1,086,306 to Oelenheinz; U.S. Pat. No. 1,437,095 to Delling; U.S. Pat. No. 1,757,477 to Rosenhoch; U.S. Pat. No. 2,122,421 to Hawkinson; U.S. Pat. No. 2,148,147 to Baier; U.S. Pat. No. 2,170,107 to Baier; U.S. Pat. No. 2,274,649 to Baier; U.S. Pat. No. 2,770,239 to Prats et al.; U.S. Pat. No. 3,612,065 to Rosen; U.S. Pat. No. 3,851,653 to Rosen; U.S. Pat. No. 3,889,689 to Rosen; U.S. Pat. No. 4,143,666 to Rainer; U.S. Pat. No. 4,194,514 to Campbell; U.S. Pat. No. 4,366,824 to Rainer et al.; U.S. Pat. No. 4,388,933 to Rainer et al.; and U.S. Pat. No. 4,641,667 to Schmekel et al.; and PCT WO 96/31255 to Giolvas, all of which are incorporated by reference herein.

As noted above, in one embodiment, bleaching the tobacco pulp can comprise chlorination of the tobacco pulp with a chlorine dioxide solution at operation 162 and caustic extraction of the tobacco pulp (e.g., with a strong based such as sodium hydroxide) at operation 166. Various alternate and additional chemicals can also be employed to bleach the tobacco input in other embodiments. For example, the chlorine dioxide solution can further comprise sulfuric acid. Other alternate or additional bleaching chemicals include sodium chlorate, chlorine, hydrogen peroxide, oxygen, ozone, sodium hypochlorite, hydrochlorous acid, hydrochloric acid, phosphoric acid, acetic acid, nitric acid, and sulphite salts. In some embodiments, employing chlorine, chlorate, or chlorite, chlorine dioxide may be produced by exposure of these chemicals to acidic conditions.

Additionally, the method can include agitating the tobacco pulp at operation 164 during chlorination of the tobacco pulp with the chlorine dioxide solution at operation 162. Agitating the tobacco pulp can increase the effectiveness of the chlorine dioxide solution in delignifying the tobacco pulp by ensuring more uniform exposure of the tobacco pulp to the chlorine dioxide solution.

In some embodiments, bleaching the tobacco pulp can comprise an ordered sequence, which can include one or more additional chlorination or caustic extraction stages. For example, as illustrated in FIG. 1, after chlorination of the tobacco pulp with a chlorine dioxide solution at operation 162 and caustic extraction of the tobacco pulp at operation 166, the method can also include chlorination of the tobacco pulp with a chlorine dioxide solution (e.g., a second chlorine dioxide solution) at operation 168. In this regard, more than one chlorination operations may be used to provide further delignification, when conducted after caustic extraction at operation 166. Each of the additional chlorination operations can comprise in situ acidification of sodium chlorite and agitating the tobacco pulp, as described above with respect to previous operation 164. The components and concentrations of the chlorination solutions employed in the various chlorination operations (e.g., 162 and 168) can be the same or differ from one another.

The various bleaching operations can be described in an abbreviated form as follows. However, it should be understood that these bleaching operations are described for example purposes only. In this regard, the bleaching operations may differ from those described below:

"D"—treatment with chlorine dioxide ($ClO_2$) under acidic conditions, to attack and fragment lignin and other oxidizable materials. Instead of adding $ClO_2$ solution directly to the raw material, sodium chlorite can be first mixed into the slurry, followed by acidification to liberate the $ClO_2$ gas in situ. In one example embodiment, the D stage can occur over the course of about 0.5 hours to about 3.5 hours, or from about 0.5 hours to about 3 hour, or from about 1 hour to 2 hours (or at least 0.5 hours, or at least 1.0 hour). The D stage can be conducted at a temperature ranging from about 40° C. to about 100° C., or about 60° C. to about 80° C. (or at least 40° C., or at least 60° C.). The $ClO_2$ can define a weight ranging from about 3% to about 30% of the weight of the tobacco pulp. The amount of $ClO_2$ at the beginning of the chlorination is determined according to the following formula: 0.21×initial kappa number measured of dissolving pulp mixture. The "Kappa Number" is used to ensure that the same amount of bleaching is done in a chlorine dioxide (D) stage, regardless of the Kappa number (lignin content) of the incoming pulp. That is, the bleaching operation calls for more chlorine dioxide to be applied as the incoming Kappa number increases. In some embodiments the D stage can also include exposure of the tobacco pulp to a strong acid such as sulfuric acid ($H_2SO_4$). The sulfuric acid can define a weight that ranges from about 0.5% to about 20% of the weight of the tobacco pulp. In some embodiments, the amount of sulfuric acid used is the amount required to adjust the pH to a value below 4 of the dissolving pulp mixture. The pH of the dissolving pulp mixture is acidic, e.g., the pH is below about 6, preferably below about 4. The consistency of the mixture in the D stage can range from about 1% to about 20%, or from about 5 to about 15%. In this regard, "consistency" is a paper industry term used for percentage of solids in a reaction mixture. For example, bleaching at 6% consistency would use 6 dry grams of treated material for every 94 grams of water and chemical mixed therewith.

"E"—treatment with a strong base such as sodium hydroxide (NaOH), to solubilize small-to-intermediate sized lignin fragments generated during oxidation. Lignin fragments are normally not soluble under acidic conditions, so most bleaching stages done at low pH can be followed by an E stage. In one example embodiment, the E stage can occur over the course a time period ranging from about 30 minutes to about 120 minutes, or from about 60 minutes to about 75 minutes (or at least 30 minutes, or at least 60 minutes). The E stage can be conducted at a temperature ranging from about 50° C. to about 90° C., or from about 60° C. to about 85° C., or from about 65° C. to about 75° C. (or at least 50, or at least 60° C., or at least 75° C.). The NaOH can define a weight that ranges from about 1.5% to about 10% of the weight of the tobacco pulp. The consistency of the mixture in the E stage can range from about 1% to about 10%.

"E(P)"—an E stage with hydrogen peroxide ($H_2O_2$) or other oxidizing agent added for increased brightness and lignin removal. The E(P) stage can be substantially similar to the above-described D stage. Further the $H_2O_2$ can define a weight that ranges from about 0.2% to about 10% of the tobacco pulp. Other example oxidizing agents include oxygen, ozone, hypochlorites, and peroxide.

The method can include various other operations, including neutralizing a remaining portion of the chlorine dioxide solution with sodium hydroxide at operation 170. In one embodiment neutralizing a remaining portion of the chlorine dioxide solution at operation 170 can be conducted after chlorination of the tobacco pulp at operation 162, and after chlorination of the tobacco pulp at operation 168. In another embodiment, neutralizing a remaining portion of the chlorine dioxide solution at operation 170 can be conducted after the entirety of the bleaching operation is complete, as illustrated in FIG. 1. Neutralizing the remaining portion of the chlorine dioxide solution can conclude the tobacco pulp preparation and excess solvent can be removed to collect the final tobacco pulp material. In some embodiments, operation 170 may comprise neutralization of other bleaching agents besides chlorine dioxide.

Typically, the average cooking yield when cooking tobacco input ranges from about 25 to about 50%, or about 30 to about 45%, based on the weight of tobacco input prior to cooking. For example, in some embodiments, the average cooking yield using tobacco root is about 44%. In other embodiments, the average cooking yield using tobacco stalk is about 34%. In other embodiments, the average cooking yield for tobacco fiber is about 31%.

The amount of lignin remaining in the tobacco pulp prior to bleaching can be determined with the "Kappa number" test, which consists of oxidation of the tested substance with potassium permanganate, followed by titration of the reaction liquid to see how much of the applied permanganate can be consumed. Lignin can be easily oxidized this way, while carbohydrates (e.g., hemicellulose and cellulose) cannot. Ideally, a "pure" cellulose or carbohydrate material should have a Kappa number less than 1. In some embodiments, the Kappa number of tobacco pulp ranges from about 10 to about 22, preferably from about 16 to about 20. In some embodiments, the Kappa number of pulp processed from tobacco root ranges from about 17 to about 20. In some embodiments, the Kappa number of pulp processed from tobacco stalk ranges from about 16 to about 21. In some embodiments, the Kappa number from pulp generated from tobacco fibers ranges from about 10 to about 16.

The EA charge (concentration of alkaline constituents present in the liquor) consumed during the pulping process ranges from about 15% to about 25%, or from about 17% to about 23% based on the amount of EA charge prior to the pulping process. The EA charge present before treatment ranges from about 22 to about 28%.

In some embodiments, the reject content in tobacco pulp was less than 10%, preferably less than 5%, more preferably less than 1%. In some embodiments, the reject content in pulp processed from tobacco root was less than 0.5%. In some embodiments, the reject content in pulp processed from tobacco fiber was less than 5%. In other embodiments, the amount of reject content in pulp processed from tobacco stalk was less than 0.5%.

Bleaching of the tobacco pulp after chemical pulping, can involve a D-E(P)-D sequence. In other words, bleaching the pulp can involve chlorinating the tobacco pulp at operation 162 (e.g., conducted at about 60° C. for about 0.5 hour with about 9% consistency and a pH of about 3.5 with $ClO_2$), caustically extracting the tobacco pulp at operation 166 (e.g., conducted at about 75° C. for about 1 hour with about 0.3% peroxide, 1.5% NaOH, and 0.1% Epsom salt), and chlorinating the tobacco once more at operation 168 followed by neutralization 170 (e.g., conducted at about 70° C. for about 3 hours with a 9% consistency, including neutralization with NaOH to adjust pH to about 10).

In this regard, chemical pulping the tobacco input with relatively mild chemical and temperature conditions, rejecting a relatively large portion of the tobacco during the filtering operation 144, and bleaching the tobacco pulp can result in a product suitable for use in the production of tobacco pulp material. However, the amount of the strong base, the H-factor, the portion of the tobacco input that is removed, and various other factors can vary from the above-described conditions in some embodiments.

Further, although chemical pulping is generally described herein with respect to certain example parameters, other parameters and chemicals may be employed in other embodiments. For example, parameters and chemicals traditionally associated with the Kraft process may be employed in some embodiments. Accordingly, it should be understood that the disclosure provided herein is provided for example purposes only.

Several mechanical processes can be used next to isolate cellulose nanomaterials (e.g., cellulose microfibrils (CMF), cellulose nanofibrils (CNF), cellulose nanocrystals (CNC)) from the tobacco pulp. Often these mechanical processes are referred to as fibrillation processes, which can transform tobacco pulp into any one of these cellulose nanomaterials depending on the mechanical process selected. These mechanical processes include refining/high-pressure homogenization, microfluidization, grinding, and cryocrushing. In addition to using these mechanical processes the pulp may also be exposed to various pre-treatment methods prior to using one or more mechanical processes.

Pre-treatment methods comprise chemical, enzymatic, mechanical processes or combinations thereof and are primarily employed to remove undesirable substances from the nanocellulose containing pulp in order to reduce the amount of energy required to further process the pulp into nanocellulose based materials using high energy mechanical processes such as grinding, homogenization or microfluidization.

For example, chemical pre-treatments methods comprise surface cellulose modifications such as TEMPO ((2,2,6,6-tetramethyl-piperidine-1-yl)oxyl) oxidation, peroxide oxidation, carboxymethylation, and acetylation but also comprises treatment of the tobacco pulp with acid or base to remove undesired components in the pulp that make nanomaterial production more difficult. These surface modifications introduce charged groups onto the surface of the cellulose such as aldehydes, carboxylates and acetylates, which break up the hydrogen bonding amongst the hydroxyl groups present on the surface of the cellulose. With less hydrogen bonding present on the surface of the cellulose material less mechanical energy is now required to break these bonds and foster homogenization.

In some embodiments, chemical pre-treatments methods comprise treating the pulp using acid hydrolysis methods. Controlled acid hydrolysis using acids such as sulfuric or hydrochloric hydrolyses the amorphous sections of the native cellulose and the crystalline sections can be retrieved from the acid solution by centrifugation and washing to obtain rod like highly crystalline cellulose nanocrystal (CNC) particles. The dimensions of the crystalline particles primarily depend on the native cellulose source material, hydrolysis time and temperature.

In some embodiments, chemical pre-treatments methods comprise exposing the pulp to alkaline treatments in order to disrupt the lignin structure within the fibers and help to separate the structural linkages between lignin and carbohydrates. Purification by mild alkali treatment of the tobacco pulp results in the solubilization of lignin, pectins and hemicelluloses.

When enzymatic pre-treatment methods are applied, the pulp is exposed to endoglucanases and/or hemicellulases. Endoglucanases are enzymes capable of splitting the polysaccharide chain in cellulose into shorter polysaccharide chains of cellulose, while hemicellulases are a group of enzymes capable of breaking down hemicellulose. In some embodiments, the tobacco pulp is treated with endoglucanases. In some embodiments, the tobacco pulp is treated with hemicellulases.

Mechanical pre-treatment methods include mechanical shearing, grinding, beating, refining, and homogenizing. These methods are often combined with other pre-treatment methods (e.g., chemical or enzymatic pre-treatment methods).

Certain embodiments of the present disclosure are directed to the use of pre-treatments methods, which are applied to the tobacco pulp before a mechanical process. In some embodiments, the pre-treatment method comprises a chemical, enzymatic, mechanical method or combinations thereof. In some embodiments, the tobacco pulp is treated with a chemical pre-treatment followed by a mechanical pre-treatment. For example, the tobacco pulp can be treated with TEMPO followed by homogenization (e.g., microfluidizer). In some embodiments, the tobacco pulp is treated with an enzymatic pre-treatment followed by a mechanical pre-treatment. For example, the tobacco pulp can be treated with endoglucanases followed by homogenization (e.g., microfluidizer). In other embodiments, the tobacco pulp is treated with a mechanical pre-treatment followed by a chemical and/or enzymatic pre-treatment. In some embodiments, the tobacco pulp is not exposed to any pre-treatments methods.

The tobacco pulp can be treated with at least one of the following mechanical processes comprising refining/high-pressure homogenization, micro fluidization, grinding, cryocrushing, or combinations thereof. In some embodiments, at least one mechanical process that can be applied to the tobacco pulp after the above mentioned pre-treatment methods.

In some embodiments, the mechanical process is refining/high-pressure homogenization or microfluidization adapted to fibrillate the tobacco pulp. This treatment consists of optional pre-refining followed by a high pressure homogenizing in which a diluted cellulosic suspension is forced through, for example, a gap between a rotor and stator disk of a refiner. The disks surfaces are grooved and fitted with bars to subject the fibers to repeated cyclic frictional stresses. During homogenization, the refined cellulose fibers are pumped at high pressure and fed through a spring loaded valve assembly. As this valve opens and closes at a fast rate, the fibers are exposed to a large pressure drop with shearing and impacting forces. This combination of forces promotes a high degree of microfibrillation of the cellulose fibers. Typically, the procedure is repeated several times in order to increase the degree of fibrillation. After each pass, the particles become smaller and more uniform in diameter. An alternative to the homogenizer is the microfluidizer, in which the tobacco pulp passes through, for example, thin z-shaped chambers under high pressure. In some embodiments, the internal diameter of such z-shaped chambers ranges from about 100 to about 500 μm, preferably from about 200 to about 400 μm. In some embodiments the pressure ranges from about 100 bar to about 2500 bars, preferably 1000 bars to about 2200 bars. In some embodiments, the pressure during the fibrillation step is at least about 100 bar or at least about 500 bar or at least about 1000 bar. The shear rate can be as high as 100,000,000 $s^{-1}$ when applied to generate cellulose nanofibers. The level of dilution of the tobacco pulp slurry used in the fibrillation step can vary, but will typically be highly dilute such as a tobacco pulp suspension having a consistency of less than about 5%, often less than about 4%, or less than about 3% or less than about 2%, with a preferred range being about 1 to about 5% or about 1 to about 3%.

In some embodiments, the mechanical process is grinding. Cellulose fibers present in tobacco pulp can be fibrillated from a pulp suspension passed between the static and the rotating grinding stones of a commercial grinder (e.g., Masuko grinder). In this process, the cell wall structure is broken down by the shearing forces of the grinding stones. The pulp is passed between a static grind stone and a rotating grind stone. In some embodiments, the rotating grind stone is revolving at about 500 rpm to about 2000 rpm, preferably from about 1000 rpm to about 1750 rpm. The nanofibers that compose the cell wall in a multilayer structure are thus individualized and separated from the pulp. Typically, after about one to about three passes, at least 30%, at least 40%, at least 50%, at least 60%, at least 70%, at least 80%, or at least 90% of the fibers are turned into nano-sized fibers (with an upper boundary of 100%), wherein at least one dimension of the fibers is less than about 1 micron or less than about 100 nm (with a lower boundary of 0). After about five passes, at least 50% of the fibers become nano-sized fibers.

In some embodiments, the mechanical process is cryocrushing. Cryocrushing is an alternative method for producing nanofibers where fibers are frozen using liquid nitrogen and then high shear forces are applied. Typically when the frozen fibers are under high impact forces, ice crystals exert pressure on the cell walls, causing them to rupture liberating microfibrils. The cryocrushed fibers may then be dispersed uniformly into water suspension using a disintegrator before high pressure fibrillation. This process sequence is applicable to cellulosic materials originating from several raw materials.

Certain embodiments of the present disclosure are directed to the use of mechanical processes for the isolation of cellulose nanomaterials from the tobacco pulp. In some embodiments, the tobacco pulp is subjected to one or more of a mechanical process comprising refining/high-pressure homogenization, microfluidization, grinding, or cryocrushing. In some embodiment, only one mechanical process is used to treat tobacco pulp. In certain embodiments, the mechanical process comprises microfluidization.

In some embodiments, the tobacco pulp is treated with one or more mechanical processes comprising one or more passes, wherein the number of passes ranges from about one to about thirty passes, preferably from about one to about 10 passes, more preferably from about one to about 6 passes (i.e., no more than 30, or no more than 10, or no more than 5 passes). For example, the tobacco pulp is subjected to a mechanical process comprising no more than 5 passes. In another example, the tobacco pulp is subjected to a mechanical process comprising no more than 3 passes. In another example, the tobacco pulp is subjected to a mechanical process comprising only one pass.

In some embodiments, the tobacco pulp is treated with a pre-treatment method before a mechanical process. In some embodiments, the tobacco pulp is treated with a mechanical pre-treatment prior to a mechanical process. For example, the tobacco pulp is treated with a grinding process (e.g., Masuko grinder) prior to a mechanical process (e.g., microfluidizer).

In some embodiments, the tobacco pulp is treated with one or more pre-treatment methods and one or more mechanical processes, wherein the total number of passes ranges from about 2 to about 30, preferably from about 2 to about 15, more preferably from about 2 to about 8.

In some embodiment, the cellulose containing nanomaterials isolated from tobacco pulp using one or more of pre-treatment methods, mechanical processes, or combinations thereof comprise cellulose microfibrils (CMF), cellulose nanofibrils (CNF), or cellulose nanocrystals (CNC). In one embodiment, cellulose nanomaterial isolated from tobacco pulp is CNF.

In some embodiments, the cellulose nanomaterials isolated from the tobacco pulp using one or more pre-treatment methods and/or mechanical processes described in previous embodiments is obtained in a yield of at least 50%, or at least 60, or at least 70%, or at least 80%, to at least 90%, or at least 95% by weight based on the initial weight of tobacco pulp used.

In some embodiments, the cellulose nanomaterial isolated from the tobacco pulp comprises a purity of at least 80%, or at least 85%, or at least 90%, or at least 95% by weight. The term "purity" describes the extend of the presence and/or absence of undesired by-products. The higher the degree of purity the smaller the amount of undesired by-products present.

Method of Making Tobacco Nanocellulose-Based Film

In some embodiments, the cellulose nanomaterial can be further processed to produce nanocellulose-based film. The tobacco nanocellulose-based films described herein are generally prepared according to the methods described in U.S. Patent Application No. 2014/0255688 to Salminen et al., which is hereby incorporated by reference in its entirety. The preparation of thin and dense films of cellulose nanofibrils is first carried out on a support material with a tailored surface energy in order to control the adhesion and the spreading of CNF on the support material. In some embodiments, the film is applied and spread out directly onto the surface of the support material as a suspension of cellulose nanofibrils, whereby the CNF forms a film. The formed CNF films can be removed from the support to provide thin films of only CNF. In some embodiments, the support material is made of, for example, polyethylene, polypropylene, polyamide, polyvinyl chloride (PVC) and polyethylene terephthalate (PET), or combinations thereof. Activation of the surface of the support material may comprise using a plasma or corona treatment.

The films are prepared on such film support materials by controlling the adhesion and the spreading of the CNF on the support material. In some embodiments, the films are detachable and removable from the support material. The adhesion (and the spreading) is generally a function of the surface energy of the CNF being spread and the type of support material being used. In some embodiments, either the CNF and/or the support have to be modified to optimize the adhesion of the CNF onto the support material.

Figure 4:
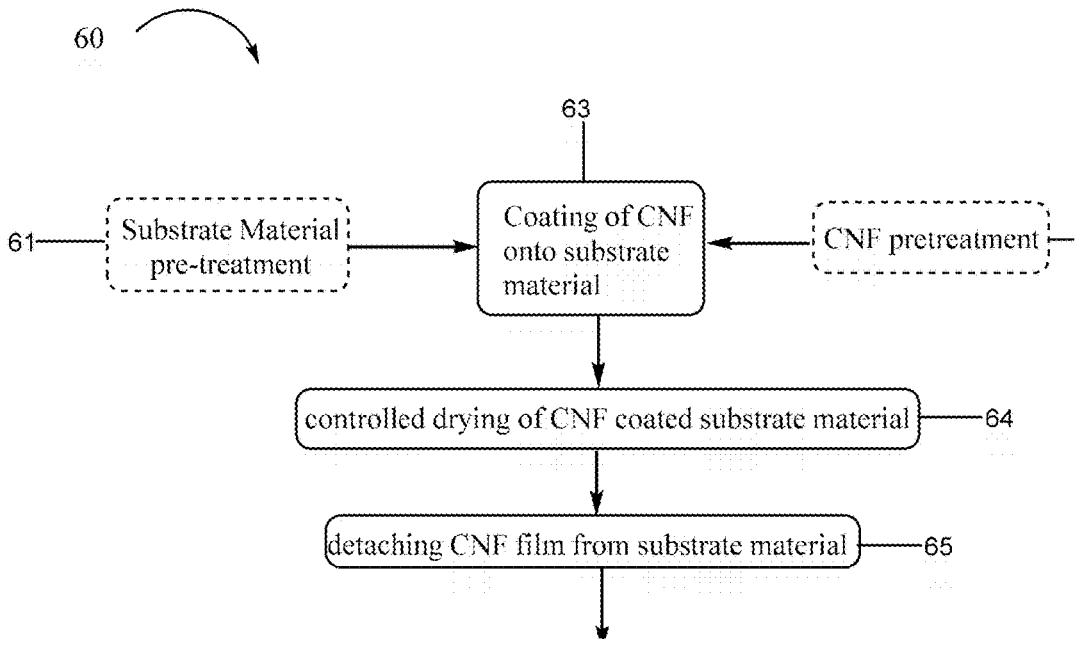
FIG. 4 is a diagram showing the individual steps of a process, which makes a nanocellulose-based film, wherein the dashed boxes represent optional steps in the process.

For example, as illustrated in FIG. 4, the method 60 can comprise a step of pre-treating the surface of the support (e.g., plasma or corona treatments) and/or a step of modifying the surface of the CNF (e.g., silylation), steps 61 and 62 respectively. Since the attachment of the CNF onto the support takes place via the reactive groups on the surfaces of both the CNF and the support, such as the hydroxyl groups on the cellulose surface, the addition of further reactive groups on both the CNF and the support will naturally increase the adhesion, as will increasing the hydrophilic nature of the support (hydrophilized e.g., using plasma or corona treatments) when used together with hydrophilic CNF, or adding hydrophobic groups on the support surface when used together with hydrophobic CNF.

For example, compatible combinations of CNF and support include selecting support layers with surface energies which allow sufficient spreading and adhesion of CNF. Examples of these would be hydrophobic support and hydrophobized CNF (e.g., polystyrene/PE/PP+silylated CNF) as well as hydrophilic support and hydrophilic CNF (e.g., cellulose derivative supports+unmodified CNF). Another example for a compatible combination of CNF and support includes selecting support layers with surface energies that can be tailored using, e.g., corona/plasma treatments in order to enhance the compatibility with the CNF (e.g. plasma/corona treated PE+unmodified CNF).

In some embodiments, the cellulose nanofibrils can be dispersed into water or another solvent wherein the CNF forms a gel, particularly selected from unmodified, hydrophobized or otherwise chemically modified CNF, such as CNF modified by introducing reactive groups. For example, the CNF can be modified via oxidation or silylation of surface hydroxyl groups. The suspension of cellulose nanofibrils is formed using a solvent or a solvent mixture consisting of a mixture of water and an organic solvent, ranging from about 1:5 to about 5:1 mixture of water and an organic solvent. The organic solvent is selected based on its hydrophobicity/polarity, i.e., by providing a solvent or a solvent mixture having a polarity that essentially matches that of the CNF or the modified CNF. In some embodiments, the suspension is formed using a solvent mixture consisting of water and a polar organic solvent (e.g., alcohol).

In some embodiments, both the cellulose nanofibrils and the support material may be chemically modified, prior to formation of the film, by the addition of charged, hydrophobic or polar functional groups, preferably selected from functional groups containing one or more O, S or N atoms or one or more double bonds, most suitably selected from hydroxyl and carboxyl groups.

In other embodiments, the surface of the CNF is modified using chemical grafting techniques or polymer grafting techniques. For example, in some embodiments, the surface of the CNF has been modified via acetylation methods. Carboxylic acids, acid anhydrides or acid chlorides (e.g., acetyl chloride or palmitoyl chloride) are used as reacting agents to generate an ester functionality with the surface hydroxyl groups of the CNF. Other examples of CNF surface modifications include silylation (e.g., chlorosilane) of the hydroxyl groups on the surface of the CNF. Additional examples include the use of surfactants or polyelectrolyte adsorbents such as fluorosurfactants (e.g., perfluorooctadecanoic acid), cationic/anionic surfactants (e.g., N-hexadecyl trimethylammonium bromide), and polyelectrolyte solutions (e.g., Poly-DADMAC, PEI, and PAH). In some embodiments, the CNF surface may be modified via grafting of a second polymer or small molecule with the hydroxyl group of the BFC to form a covalent bond. Additional modifications of the surface CNF comprise chemical modifications such as TEMPO oxidation, carboxymethylation and others known in the arts (Missoum et al. Nanofibrillated Cellulose surface Modifications: A Review, Materials, 2013, 6, 1745-1766; Dufresne et al, Nanocellulose: a new ageless bio nanomaterial, Materials Today, 16 (6), 2013, 220-227; Peng et al, Chemistry and Applications of nanocrystalline cellulose and its derivatives: A nanotechnology perspective, Canadian Journal of Chemical Engineering, 9999, 2011, 1-16).

The application onto the support may be carried out in step 63, for example by a rod, blade or roll coating method. The thickness of the film of cellulose nanofibrils applied onto the support is preferably in the range of about 50 to about 150 μm. The thickness of the support is not an essential parameter. However, generally the thickness of the used support ranges between about 150 μm and about 2000 μm.

Generally, the film suspension is dried in step 64, after applying it onto the support, via controlled evaporation, preferably at an elevated temperature (e.g., greater than 40° C.), optimized to a point where hydroxyl groups are able to interact at an advantageous rate through self-association, which leads to even film formation. In certain embodiments, the film suspension is dried at a temperature that is 60° C., such as at a temperature in the range of about 25 to about 60° C., preferably at room temperature, whereby the film material solidifies at an advantageous rate. Thus, slow dewatering via filtration is avoided. Concomitantly, the sufficient adhesion with the support material prevents the shrinkage of the CNF film upon drying.

The film may either be detached from the support prior to use or prior to further processing in step 65, or the film may be used or further processed as a layered structure while still attached to the support. The detaching may be carried out, e.g., by re-wetting the film using a solvent or a solvent mixture, most suitably using methanol.

The dried film may further be pressed, preferably by hot pressing, preferably at a temperature of about 60 to about 95° C. as in step 66, most suitably at a temperature of about 80° C., to obtain a thinner and denser film structure with a controlled porosity. The pressing can be carried out either on the film, as such, or with the film still attached to the support.

In some embodiments, a combination of a suitable support, controlled drying and an optional hot pressing enables controlling the porosity of the CNF films and, thus, transparent and strong films with advantageous thicknesses, among others having good oxygen barrier properties, can be manufactured. In some embodiments, the tobacco-based nanocellulose film can be exposed to inkjet conditions requiring sintering at 150° C. without exhibiting a change in color.

Methods of Use

As noted above, in some embodiments, the tobacco derived nanocellulose material is used in film-forming applications. These films can provide efficient oxygen permeability and water vapor permeability often required, for example, for packaging in the food industry. These nanocellulose-based films can also be used in applications in electronic devices such as, for example, inkjet printing. In some embodiments, the tobacco derived nanocellulose material used to prepare such a nanocellulose-based film comprises cellulose nanofibrils (CNF), cellulose nanocrystals (CNC), cellulose microfibrils (CMF) or combinations thereof. In some embodiments, the tobacco derived nanocellulose material used to prepare a nanocellulose-based film comprises CNF. In some embodiments, the surface of the CNF is unmodified, i.e., left in its natural state. In other embodiments, the surface of the CNF is modified to contain one or more functional groups selected from alkanes, aliphatics, aromatics, acids, esters, silanes, and a combination thereof.

In some embodiments, the tensile strength of the nanocellulose-based film is greater than about 120 Mpa, preferably greater than about 130 Mpa or greater than about 140 Mpa (e.g., ranges from about 140 to about 180 MPa or from about 150 to about 170 Mpa). In some embodiments, the strain of the nanocellulose-based film is at least about 11% or at least about 12%, such as a range from about 10 to about 15%, or from about 11 to about 14%. In some embodiments, the tensile modulus of the nanocellulose-based film is at least about 4 Gpa, such as a range from about 4 to about 6 Gpa.

In some embodiments, the nanocellulose-based film is translucent. In some embodiments, the nanocellulose-based film is transparent. For example, the film comprises a light transmittance ranging from about 60% to about 100%, or from about 80% to about 100% (or at least 60%, or at least 80%, or at least 90%) at a wavelength selected from a range of about 200 nm to about 1000 nm.

In some embodiments, the oxygen permeability of the nanocellulose-based film is less than 0.2, or less than 0.1, or less than 0.05 cc×mm/$m^2$×day at a temperature of 23° C. and at a relative humidity (RH) of 0%, and less than about 20, or less than about 10, or less than about 5 cc×mm/$m^2$×day at a temperature of 23° C. and at a relative humidity (RH) of 80%.

In some embodiments, the water vapor permeability of the nanocellulose-based film ranges is typically less than about 30 or less than about 25 g×mm/m2×day, such as a range from about 10 to about 35 g×mm/$m^2$×day at a temperature of 23° C. and at a relative humidity (RH) of 50%.

Tobacco derived cellulose nanomaterials can be used in a wide array of industrial fields in addition to film-forming applications, such as but not limited to, construction materials (e.g., surface coatings, additives in wallboard, insulation (e.g., aerogels), water retention aid, film former, rheology control agent, cement and concrete to increase toughness and durability), cosmetics/pharmaceuticals (e.g., emulsifiers, hydrating agents, rheology modifiers, film former, high water-binding capacity, used in biomedical devices), coatings/paints (e.g., rheology modifiers, improve finish and durability, increase shelf life of paint), food packaging (e.g., act as vapor barrier, freshness indicator, act as thickener or stabilizer, water binder, gelling agent), paperboard/packaging (e.g., improve strength-to-weight ratios, generates lighter-weight-end product, improve dry/wet strength), composites (e.g., polymer reinforcer, substitute for petroleum-based additives, improves biodegradability, increases thermal and mechanical stability of petroleum based plastics, used in drilling fluids), hygiene/personal care products (e.g., increased fluid absorbency), and electronics (e.g., parts/components, coatings, films).

In some embodiments, the tobacco derived nanocellulose material is a rheology modifier. Rheology modifiers commonly referred to as thickeners or viscosities are able to alter the viscosity of a formulation and as such can be present in many products. Changes in the viscosity of formulations are typically performed to improve the ease of use and/or operation of a particular formulation. As such, the application of rheology modifiers is applied to a whole variety of industrial sectors including but not limited to food products (e.g., to control texture, taste and shelf-life), pharmaceuticals (e.g., to improve ease of application, dosage, efficacy of drug component, shelf-life), cosmetics/personal care (e.g., to improve ease of application and feel, thickener agent), and construction (e.g., to ensure proper flow, settling, levelling of paint, increase in shelf-life).

In some embodiments, the tobacco derived nanocellulose material used as a rheology modifier comprises cellulose nanofibrils (CNF), cellulose nanocrystals (CNC), cellulose microfibrils (CMF) or combinations thereof. In some embodiments, the tobacco derived nanocellulose material used as a rheology modifier comprises cellulose nanocrystals (CNC). In some embodiments, the surface of the CNC is unmodified, i.e., left in its natural state. In other embodiments, the surface of the CNC is modified to contain one or more functional groups. For example, in some embodiments, the surface of the CNC has been modified via acetylation methods. Carboxylic acids, acid anhydrides or acid chlorides (e.g., acetyl chloride or palmitoyl chloride) are used as reacting agents to generate an ester functionality with the surface hydroxyl groups of the CNC. Other examples of CNC surface modifications include silylation (e.g., chlorosilane), oxidation (e.g., TEMPO oxidation), or carboxymethylation of the hydroxyl groups on the surface of the CNC. In some embodiments, the surface of the CNC has been modified by carboxylation of at least a portion of the surface hydroxy groups to render carboxylated nanocellulose crystals (cCNC).

In some embodiments, modification of the surface of the CNC alters the rheology properties of CNC. For example, solutions of modified CNC (e.g., cCNC) typically are more viscous compared to solutions containing unmodified CNC.

Some aspects of the current disclosure are directed towards modifying the viscosity of a solution or suspension, which can be conventional, associative and/or thixotropic in nature. In some embodiments, chemically modified cellulose nanocrystals (such as carboxylated nanocellulose crystals (cCNC)) are added to a solution or suspension to increase the viscosity of the solution or suspension. In some embodiments, the viscosity of a solution or suspension already comprises a rheology modifier, which can be conventional, associative and/or thixotropic in nature, is modified with cCNC. In some embodiments, cCNC is added to a solution or suspension containing at least one rheology modifier selected from cellulose ethers, polysaccharides, and clays. In some embodiments, the cellulose ether based rheology modifiers can be selected from carboxymethyl cellulose (CMC), diethylaminoethyl cellulose, ethyl cellulose, ethyl methyl cellulose, hydroxyethyl cellulose, hydroxyethyl methyl cellulose (HEC), hydroxypropyl cellulose, methyl cellulose, hypromellose or a combination thereof.

In some embodiments, the concentration of rheology modifier can vary from about 0.25% to about 5%, or from about 0.5 to about 2% by weight based on the total weight of the solution or suspension.

In some embodiments, the solution or suspension comprises a cellulose ether based rheology modifier and cCNC in a ratio from about 1:5 to about 5:1, preferably from about 1:2 to about 2:1. In some embodiments, the rheology modifier is selected from CMC, HEC, poly(ethylene)oxide (PEO), and Bentonite.

In some embodiments, the addition of cCNC to the solution or suspension comprising one or more rheology modifiers increased the overall viscosity of the solution/ suspension by at least 10%, or at least 20%, or at least 30%, or at least 40%, or at least 50%, or at least 60%, or at least 70%, or at least 80%, or at least 90% compared to the solution/suspension with no cCNC.

In some embodiments, the viscosity exhibits a pseudoplasticity behavior, wherein the viscosity at shear rates below 1 (l/) is higher compared to the viscosity measured at shear rates greater than 10 (l/s). In some embodiments, the viscosity of a solution or suspension comprises cellulose ether and cCNC both independently having a concentration ranging from about 0.5 to about 1% by weight based on the total weight of the solution, is at least 1×10−1 (Pa·s).

In some embodiments, the addition of salt (e.g., sodium chloride) to a solution or suspension comprising cCNC and one or more rheology modifiers does not alter the rheology properties of the solution or suspension significantly.

EXPERIMENTAL

The present invention is more fully illustrated by the following examples, which are set forth to illustrate the present invention and are not to be construed as limiting thereof. Testing protocols noted in the examples are understood to be the testing protocols relevant to the property ranges provided herein.

Example 1: Method of Making Tobacco Pulp

Tobacco pulp is prepared according to the methods disclosed in U.S. Patent Application No. 2016/0208440 to Byrd, Jr et al. and U.S. Pat. No. 9,339,058 to Byrd, Jr et al., which are incorporated by reference in their entireties. All pulping equipment is typically made of stainless steel. The cooking devices are either cylindrical or spherical pressure vessels. Pressure screens can be used to remove large particles and side-hill atmospheric screens can be used to remove fines.

The bleaching equipment is atmospheric cylindrical tanks and is typically made of Hastelloy or fiberglass reinforced plastics for equipment exposed to bleaches containing chlorine. Stainless steel is typically used for chlorine-free bleaches. The same types of washers can be used to remove bleach from the equipment as is generally used to clean the cooking devices. All of these components can be made by a wide variety of manufacturers such as, but not limited to, Andritz, Metso, GL&V, Black Clawson, and Beloit.

More particularly, various tobacco pulps are formed using tobacco roots, tobacco stalk, and tobacco fiber as starting materials. The starting materials are depithed as necessary. Here, stalk and fiber raw materials required depithing, i.e., removal of nonfibrous material, before cooking. Depithing was done soaking tobacco samples in cold water and dewatering using 48 mesh wire with Stalk and 200 mesh wire with Fiber. In order to avoid high material losses tighter wire was used with fine cut Fiber raw material. Depithing yield was measured. Chemical composition, metal and ash content of depithed raw materials and original Root were analyzed. Analysis methods used herein are presented in Table 1.

TABLE 1

| Analysis methods | |
|---|---|
| Extractives (heptane) | Soxhlet extraction with heptane |
| Lignin content | TAPPI-T 222 om-02 modif |
| Carbohydrates content | Acid hydrolysis + HPLC |

TABLE 1-continued

| Analysis methods | |
|---|---|
| Protein content | Calculated from the nitrogen content (determined by the Kjeldal method) using correlation constant 6.2 |
| Ash content 525° C., 900° C. | ISO 1762:2001 |
| Metal contents (Al, Ca, Cu, Fe, Mg, Mn, Si, S, Na, K) | Wet combustion (the samples are dissolved in nitric acid in a microwave oven before the analysis) + ICP-AES |
| total Cl | ISO 11480:97 |
| Residual alkali (EA) | SCAN-N 33:94 |
| Dry content of the pulp | SCAN-C 3:78 |
| Kappa number | ISO 302:2004 |
| Viscosity | ISO 5351:2010 |
| Brightness | ISO 2470-1:2009 from splitted sheet |
| Fiber distribution | Kajaani FS-300 |

Cooking conditions were optimized targeting to low reject content (high screened yield) in pulp and about 8-10 g NaOH/l residual alkali content in black liquor. These pre-trials were done air heated digester equipped with 6×1 liter autoclaves. Variables were temperature (150 and 160° C.), H-factor (400-900) and EA (effective alkali) charge (22-28%). Pulps for fibrillation trials were Kraft cooked using 15 l rotating digesters. Based on the results of pre-trials H-factor was selected to be 600 and temperature 150° C. EA charges were 24% for Root, 26% for Stalk and 28% for Fiber. Liquor to wood ratio was 5 and sulphidity 40%. Required effective alkali charges were clearly higher than with eucalyptus and birch. After cooking pulps were washed and screened. Pulp yield, kappa number, viscosity, brightness and residual alkali were measured. Chemical composition was analyzed from Root pulp.

Tobacco pulps were bleached using the bleaching sequence D-E(P)-D. D-stages were performed in 18 l air bath reactors. Sulphur acid or NaOH was used for pH adjustment before chlorine dioxide charging. After the reaction time, final pH was measured from the pulp in the reaction temperature. The residual chlorine content of the bleaching filtrate was determined. The alkaline extraction stage (EP or E) was performed in 40 l Delfi reactor. With Root and Stalk peroxide was used to improve brightness. In the case of Fiber, pulp viscosity was so low that peroxide addition was omitted. After the reaction time, final pH was measured from the pulp in the reaction temperature. The residual hydrogen peroxide content of the bleaching filtrate was determined. After every bleaching stage pulps were washed several times with deionized water and after the last bleaching stage pulps pH were adjusting to 4.5 with $SO_2$ for equalizing pH level and for terminating residual chlorine dioxide. Pulp viscosity, kappa number, brightness and carbohydrates composition were analyzed from all pulps. Bleaching conditions and results are shown in.

TABLE 2

| Conditions of DE(P)D bleaching sequences | | | | |
|---|---|---|---|---|
| | | Root | Stalk | Fiber |
| $D_0$ stage | | | | |
| | $ClO_2$ dosage, % aCl | 3.7 | 3.9 | 2.9 |
| Consistency 9% | $ClO_2$ consumption, % aCl | 3.7 | 3.9 | 2.5 |
| 60° C., 30 min | $H_2SO_4$ dosage, % | 1.2 | 1.7 | 3.8 |
| | Final pH | 2.3 | 2.5 | 6.0 |
| $E_{(P)}$ stage | | | | |
| | Epsom, % | 0.1 | 0.1 | — |
| Consistency 10% | NaOH dosage, % | 1.5 | 1.5 | 1.5 |

TABLE 2-continued

| Conditions of DE(P)D bleaching sequences | | | | |
|---|---|---|---|---|
| | | Root | Stalk | Fiber |
| 75° C., 60 min | $H_2O_2$ dosage, % | 0.3 | 0.3 | — |
| | $H_2O_2$ consumption, % | 0.25 | 0.23 | — |
| $D_1$ stage | | | | |
| Consistency 9% | $ClO_2$ dosage, % aCl | 1.7 | 1.5 | 2.4 |
| 70° C., 180 min | $ClO_2$ consumption, % aCl | 1.7 | 1.5 | 1.6 |
| | NaOH dosage, % | 0.15 | 0.15 | 0.15 |
| | Final pH | 3.5 | 3.9 | 6.4 |

In summary, Table 2 shows the chlorine dioxide bleaching with sequence D-E(P)-D used to bleach the pulps. Initial D stage is made at 9% consistency, 60° C., 30 min, and pH is adjusted to about 3.5 with $H_2SO_4$ at the beginning of the stage. The amount of $ClO_2$ is 0.21×initial Kappa number. In E(P) stage, 1.5% of NaOH, 0.1% Epsom salt and 0.3% peroxide are used, with a temperature of 75° C. and a time of 60 min. The second D1 stage conditions are 9% consistency, 70° C., 180 min, and pH is adjusted to about 10 with NaOH at the beginning of the stage.

Results

Characterization of Tobacco Raw Materials

Figure 11:
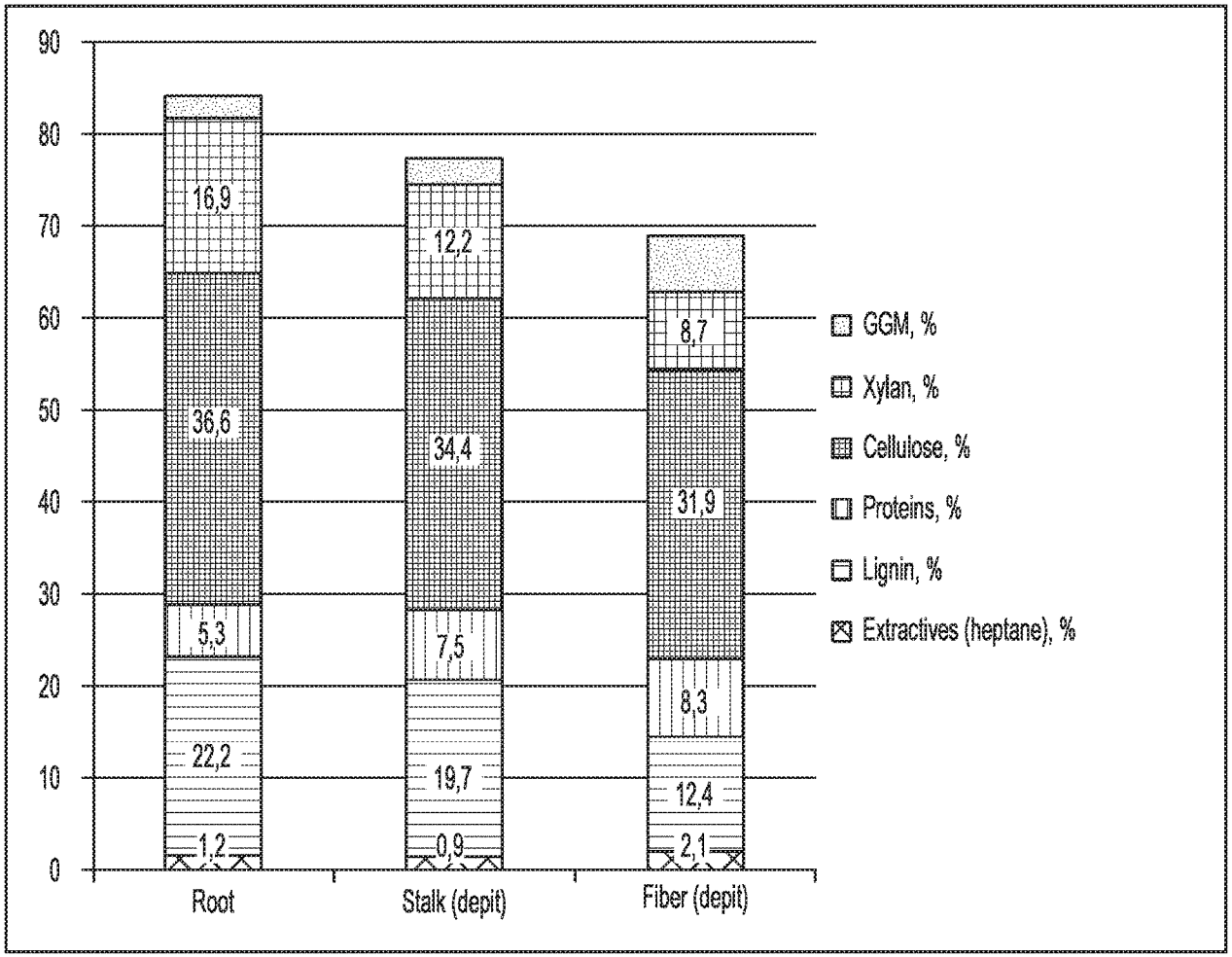
FIG. 11 is a graph showing the chemical composition of tobacco raw materials (original root, depithed stalk and depithed fiber)

Two batches of raw materials were supplied for cooking trials. Chemical characterizations were made from the first batch. Depithing yields were measured after both batches. The average yields were 88.1% with Stalk and 91.3% with fiber. Chemical composition of tobacco raw materials are presented in FIG. 11. About 84% of the composition of Root was identified. With Stalk the amount was 77% and Fiber only 69%. Based on the chemical composition Root is the most suitable raw material because of the highest cellulose and hemicellulose (xylan+GGM) content, total amount 55.5%. Fiber had the highest ash content and harmful metal contents such as Fe, Mn, Si (Table 3). The Cl and K content of Root and Stalk are clearly higher than with normal woos species. This can cause difficulties in the chemical recovery side in Kraft pulping, for example increased corrosion of recovery boiler.

TABLE 3

| Ash and metal contents of tobacco raw materials (original Root, depithed Stalk and depithed Fiber) | | | |
|---|---|---|---|
| Chemical composition | Root | Stalk (depit) | Fiber (depit) |
| Cl, total g/kg | 3.0 | 3.5 | <0.02 |
| Al, mg/kg | 150 | 25 | 310 |
| Ca, g/kg | 2.3 | 4.1 | 15 |
| Cu, mg/kg | 9.4 | 13 | 7.6 |
| Fe, mg/kg | 100 | 42 | 280 |
| K, g/kg | 17 | 15 | 3.2 |
| Mg, g/kg | 1.0 | 2.4 | 1.2 |
| Mn, mg/kg | 9.0 | 22 | 48 |
| Na, mg/kg | 97 | 40 | 33 |
| S, g/kg | 1.5 | 1.6 | 1.2 |
| Si, mg/kg | 180 | 17 | 480 |
| Ash 525° C. | 2.7 | 3.0 | 5.0 |
| Ash 900° C. | 2.1 | 2.3 | 3.8 |

Kraft Cooking

Figure 12:
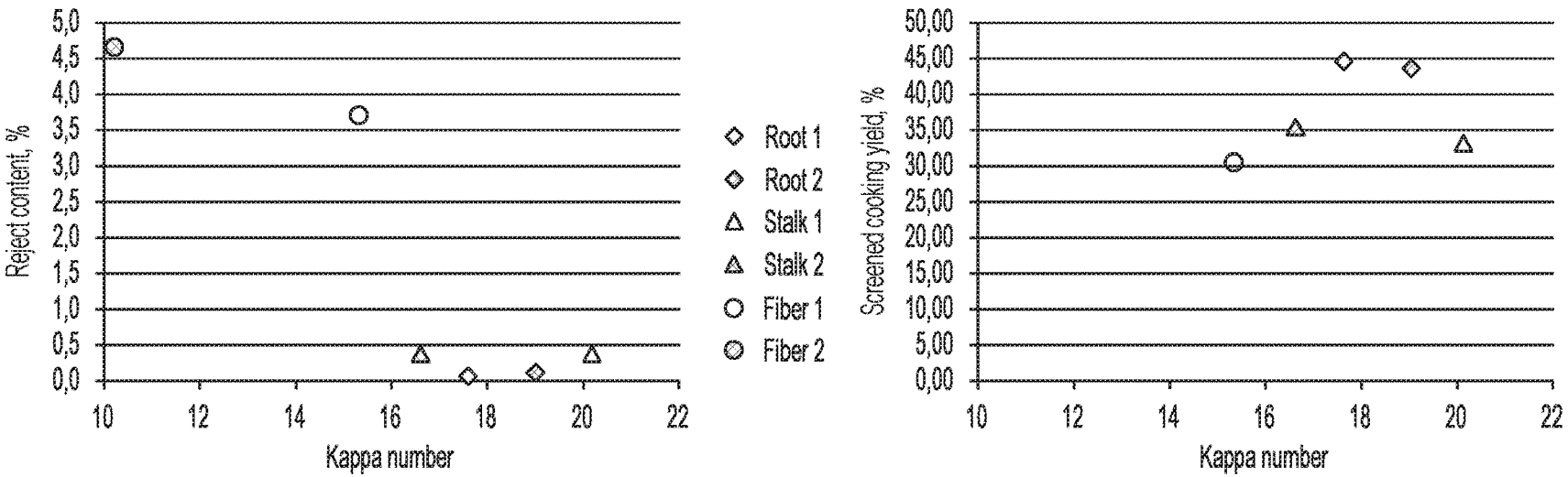
FIG. 12 is a series of graphs showing the reject content and screened yield with different tobacco raw materials and batches.

Cooking conditions were selected to result low reject content, high-screened yield and residual alkali concentration between 8 to 10 g NaOH/l. The average cooking kappa number was about 18 with Stalk and Root and about 14 with Fiber. Although Fiber was cooked to lower kappa number (lignin content) reject content was clearly higher compared to that of Stalk and Root, 4% vs. 0.5% (FIG. 12). Dewatering and handling of Fiber was complicated. Different Stalk and Fiber batches had more variations in delignification ability than Root samples.

The average cooking yields and EA consumptions were with Root 44.2% and 19 EA %, Stalk 34% yield and 21 EA % and with Fiber 30.7% and 23.5 EA %. Yield were almost 10-20% units lower compared to Birch Kraft pulp (screened yield 53% and EA consumption 17.6%, Kangas et al. 2014)

In pre-trials residual EA concentration of Stalk with the same EA charge, 24%, was 6.5 g NaOH/l, slightly lower than target value, 8-10 g NaOH/l. With Root (in small scale trials) the residual concentration was 10.5 g NaOH/1, so the combined concentration could be within the accepted level. To low residual concentration can cause condensation of dissolved lignin back to fiber surface, which will increase the consumption of bleaching chemical. In real mill process, Stalk and Root material can be cooked together, but better results will be get with separate digesters due to the higher chemical consumption of Stalk. With batch type of digesters raw materials are cooked separately and after cooking processing is continued with combined fiberline.

Bleaching

Figure 13:
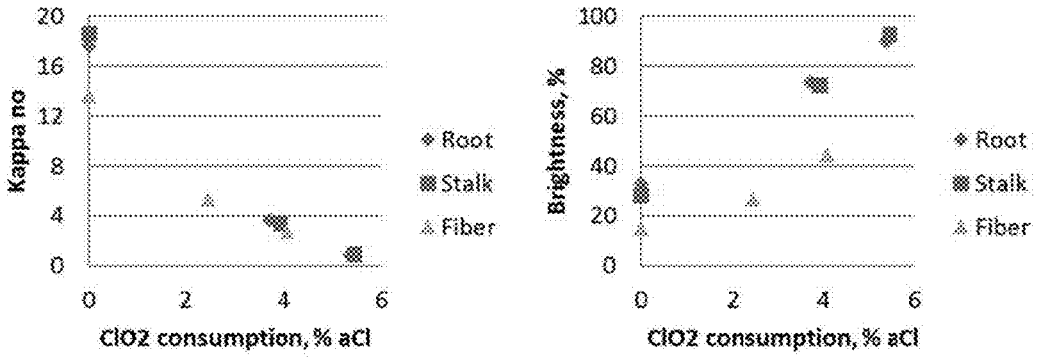
FIG. 13 is a series of graphs showing the decrease of kappa number and increase of brightness as a function of Chlorine dioxide consumption.

Chlorine dioxide bleaching with sequence D-E(P)-D was used in the bleaching of the tobacco pulps. With Fiber the use of peroxide in alkaline extraction stage was left out due to rather low viscosity after cooking. Bleaching of Fiber was difficult. With the same amount of chlorine dioxide (40 kg/tp) brightness was almost 30%-units lower (FIG. 13). The final brightness of Fiber was only 44% when the other pulps gain 89% brightness (Table 4). Bleaching yield was between 90-95% depending on the raw materials source. The highest yield was achieved with Root.

TABLE 4

| Pulp properties after bleaching | | | |
|---|---|---|---|
| | Root | Stalk | Fiber |
| Brightness, % | 89.8 | 88.8 | 44.3 |
| Kappa no | 0.8 | 0.89 | 2.72 |
| Viscosity, ml/g | 890 | 870 | 640 |
| Bleaching yield, % | 95.1 | 92.8 | 90.9 |
| TOTAL YIELD (Screened), % | 42.5 | 27.8 | 25.5 |

Chlorine dioxide consumption to full brightness was slightly higher with Stalk compared to Root, 58.5 kg/tp vs. 56.4 kg/tp (Table 5). If compared to laboratory birch pulp bleached with DED-sequence, bleachability of Root and Stalk was even better in terms of chlorine dioxide consumption per decreased kappa number and increased brightness. Based on the bleaching results, Root is the most interesting raw material for the pulping.

TABLE 5

| Bleaching chemical consumption to full brightness with Root and Stalk | | | |
|---|---|---|---|
| | ROOT | STALK | Birch (ref.) |
| ClO2 as aCl, kg/t bleached pulp | 56.4 | 58.5 | 53.3 |
| H2SO4, kg/t bleached pulp | 12.6 | 18.3 | 7.8 |
| MgSO4, kg/t bleached pulp | 1.1 | 1.1 | |
| NaOH, kg/t bleached pulp | 17.4 | 17.8 | 24.0 |
| H2O2, kg/t bleached pulp | 2.67 | 2.47 | |
| Brightness increased, % | 57.1 | 60.3 | 50.5 |
| Kappa no decreased | 16.8 | 17.7 | 15.5 |

TABLE 5-continued

| Bleaching chemical consumption to full brightness with Root and Stalk | | | |
|---|---|---|---|
| | ROOT | STALK | Birch (ref.) |
| kg aCl/% of brightness gained | 0.99 | 0.97 | 1.05 |
| kg aCl/no of Kappa decreased | 3.36 | 3.30 | 3.44 |

Characterization of Pulps

Figure 14:
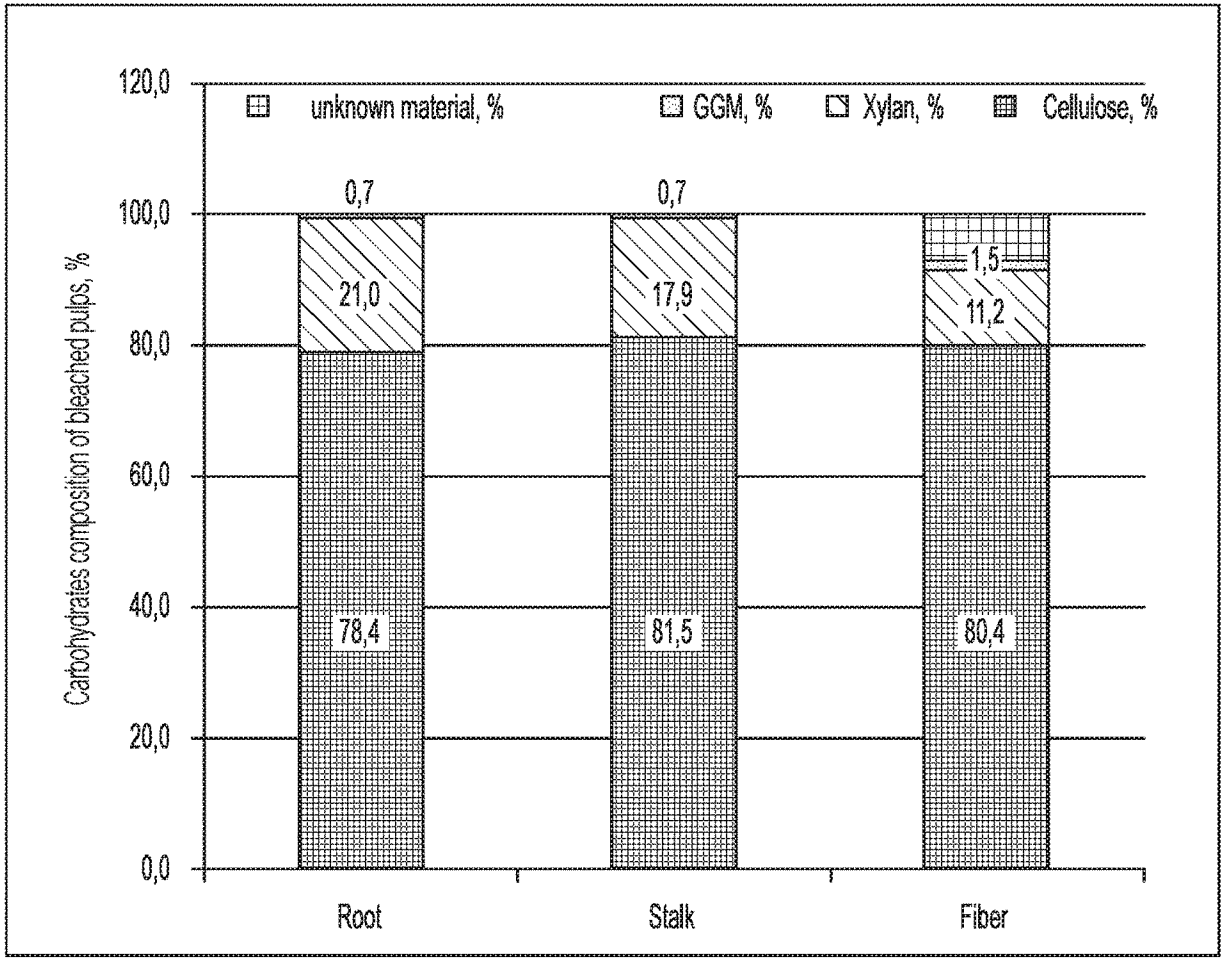
FIG. 14 is a graph showing the carbohydrates composition of bleached pulps.
Figure 15:
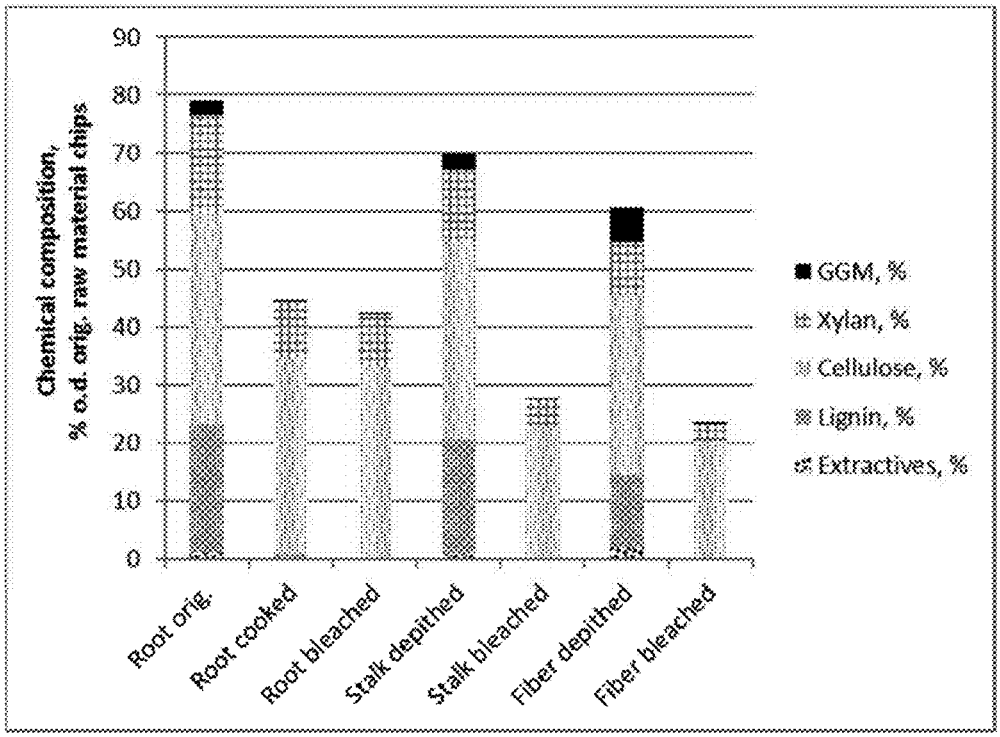
FIG. 15 is a graph showing the chemical compositions of raw materials and pulps calculated from the original raw material.

Carbohydrates composition (FIG. 14) and fiber distributions (Table 6) were analyzed from the bleached pulps. In Root and Stalk about 80% of pulp is cellulose and ~20% hemicelluloses mainly Xylan. Fiber pulp includes over 5% other components than carbohydrates. After bleaching the highest carbohydrates yield calculated from the original raw material (~42%) was gained from Root and lowest from Fiber, ~24% (FIG. 14). Stalk had the highest arithmetic and length weighted fiber length. Fiber had highest amount of fines material and vessel type of fibers. Its kink index was lowest. A comparison of chemical composition of the various starting materials as compared to the same materials after cooking and/or bleaching is set forth in FIG. 15.

TABLE 6

| Fiber distribution of bleached pulps | | | |
|---|---|---|---|
| | Sample | | |
| Fibre distribution, FS-300 | Root | Stalk | Fiber |
| Arithmetic av. fibre length, mm | 0.36 | 0.47 | 0.32 |
| Length weighted av. fibre length, mm | 0.56 | 0.66 | 0.61 |
| Weight weighted av. fibre length, mm | 0.65 | 0.83 | 1.17 |
| Length <0.2 mm, % | 3.29 | 5.67 | 14.94 |
| Coarseness, mg/m | 0.132 | 0.108 | 0.169 |
| Fiber curl, % | 11.1 | 13.8 | 11.4 |
| Kink index, 1/m | 1054 | 1438 | 569 |
| Fiber width, μm | 21.0 | 18.7 | 19.6 |
| Vessels, 1/1000 fibers | 32 | 62 | 101 |

Based on these results, the tobacco Root was the most promising raw material for the pulping and fiber source for preparation of nanocellulose materials.

Example 2: Preparation of Nanocellulose Materials

Cellulose nanofibrils (CNF) are produced using never dried tobacco waste pulps produced as set forth in Example. The fiber slurry is first soaked at 1.7% consistency and dispersed using a high shear Diaf dissolver for 10 minutes at 700 rpm. The suspension is pre-refined in a grinder (Supermasscolloider MKZA10-15J, Masuko Sangyo Co., Japan) at 1500 rpm. The pre-refined fiber suspension is fed into a Microfluidizer M-7115-30. First pass is through the chambers having a diameter of 500 μm and 200 μm. The next four passes are through the 500 μm and 100 μm chambers. The fibrillated samples are produced after 1, 3 and 5 passes and the operating pressure is 1800 bar. The specific energy consumption varies between 4 (one pass) to 25 kWh/kg (five passes). The fiber slurry becomes a viscous gel after the mechanical treatment with a final solid content of 1.6-1.8%.

Figure 2:
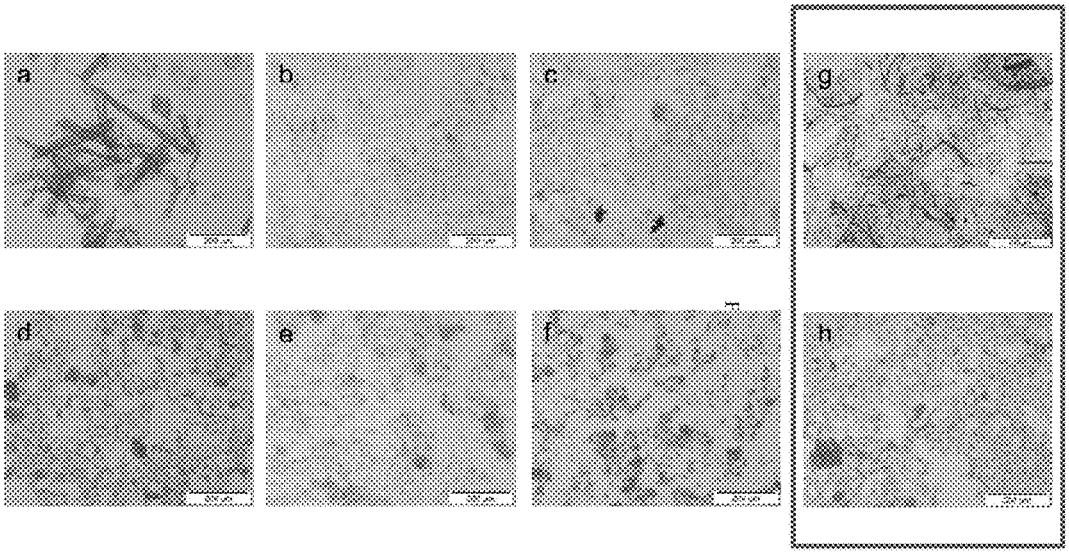
FIG. 2 is a series of panels showing images of cellulose nanomaterials made from various tobacco materials and comparative samples: (a) tobacco waste CMF; (b) tobacco stalk after 5 passes; (c) tobacco root after 5 passes; (d) unbleached tobacco root after 5 passes; (e) tobacco root washed with sodium in Na-form after 5 passes; (f) tobacco fiber after 5 passes; (g) comparative sample wood-based CMF (Daicel Celish KY100G); and (h) comparative sample hardwood-based CNF sample.

Apparent viscosity is measured at 1.5% fixed consistency for a comparison with Brookfield rheometer RVDV-III at 10 rpm and using the vane spindles. Imaging is done using optical microscopy and the images are presented in FIG. 2. As shown in the images, only a few fibril bundles still exist in the fibrillated stalk, root and fiber sample, but the amount of residual fibers is negligible.

Figure 3:
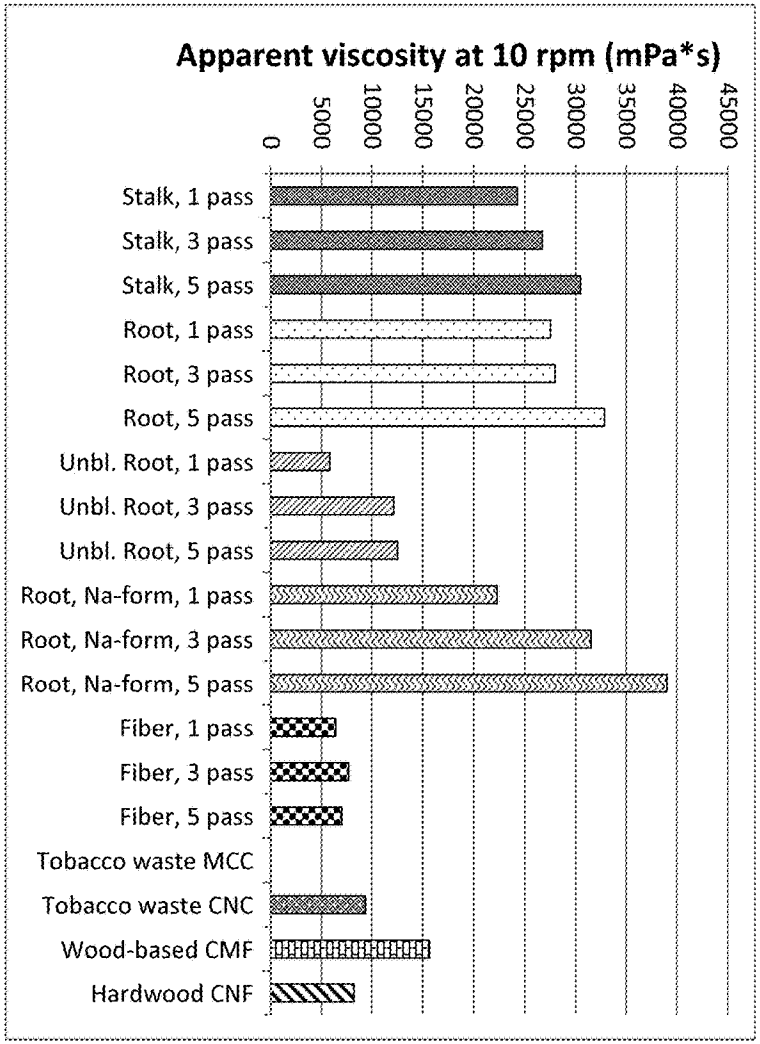
FIG. 3 is a bar graph showing the viscosity measurements of nanocellulose material derived from tobacco stalk, root and fiber and comparative wood-based materials using various fibrillation cycles (e.g., 1 pass, 3 pass, and 5 pass)

The viscosity data is presented in FIG. 3. The tobacco-derived hydrogels have relatively high apparent viscosities compared to the reference wood-based samples, which have apparent viscosity values between 8000-15000 mPa*s. Especially CNF made of root and stalk pulps have exceptionally high viscosities 24000-32000 mPa*s already after one and three fibrillation cycles. The highest apparent viscosity, 39000 mPa*s, is measured after five fibrillation cycles when the raw material is the root pulp in Na form (e.g., the pulp was ion exchanged into sodium form). Tobacco nanocellulose materials that were not bleached as part of the pulping process exhibit a viscosity that is similar to wood-based materials, but well below the viscosity of nanocellulose materials prepared from root and stalk materials that are bleached as part of the pulping process. Pulps formed from tobacco fibers also exhibit a viscosity that is similar to wood-based materials, but well below the viscosity of most nanocellulose materials prepared from root and stalk materials. Applications for these materials include, but are not limited to, stabilizing agents, rheology modifying agents, strength enhancing agents, or film formation agents.

Example 3: Preparation of Nanocellulose-Based Film and Application Trials

Films are made using SUTCO surface treatment technology available from VTT Technical Research Centre of Finland Ltd and described in International Application No. 2014/0255688 to Salminen et al., which is hereby incorporated by reference in its entirety. The process is a solution casting type process where a CNF suspension having adequate viscosity is cast on a moving plastic web. The plastic is pre-treated using a plasma device with a predetermined power level. The correct level is tested on a hand sheet scale before trials.

The CNF containing suspensions are agitated before film making in a high shear mixer. After 60 minutes of mixing, an additive (sorbitol) is added to the mixing vessel and mixing is continued for another 60 minutes. After mixing, air is removed from the suspensions by mixing for 5 minutes in a vacuum. This ensures that no air bubbles are present as the CNF suspension is cast on the support web. After mixing, the required amount of suspension for film making is cast on the plastic web substrate to form a film. The formed films are allowed to dry in ambient conditions for a required time and then detached from the substrate. Optionally, smoothed CNF films can be prepared using pressing or calendering.

Figure 5:
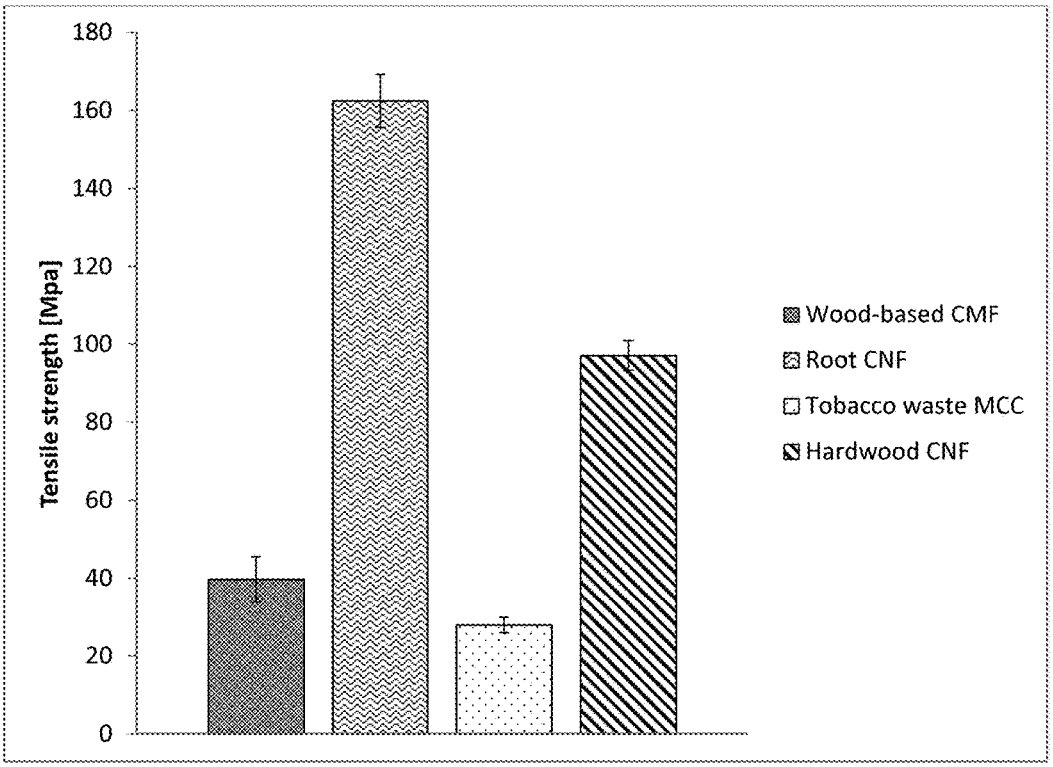
FIG. 5 is a graph showing the tensile strength of nanocellulose-based films from tobacco-derived materials and comparative wood-based materials.
Figure 6:
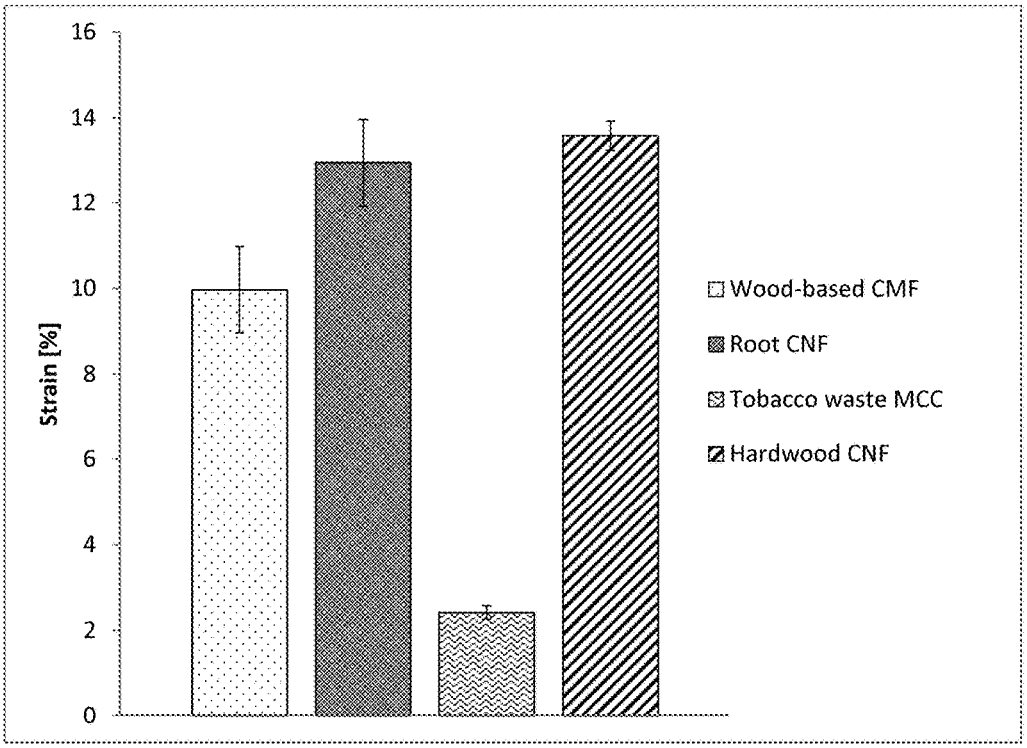
FIG. 6 is a graph showing the strain of nanocellulose-based films from tobacco-derived materials (e.g., tobacco-derived film) and comparative wood-based materials.
Figure 7:
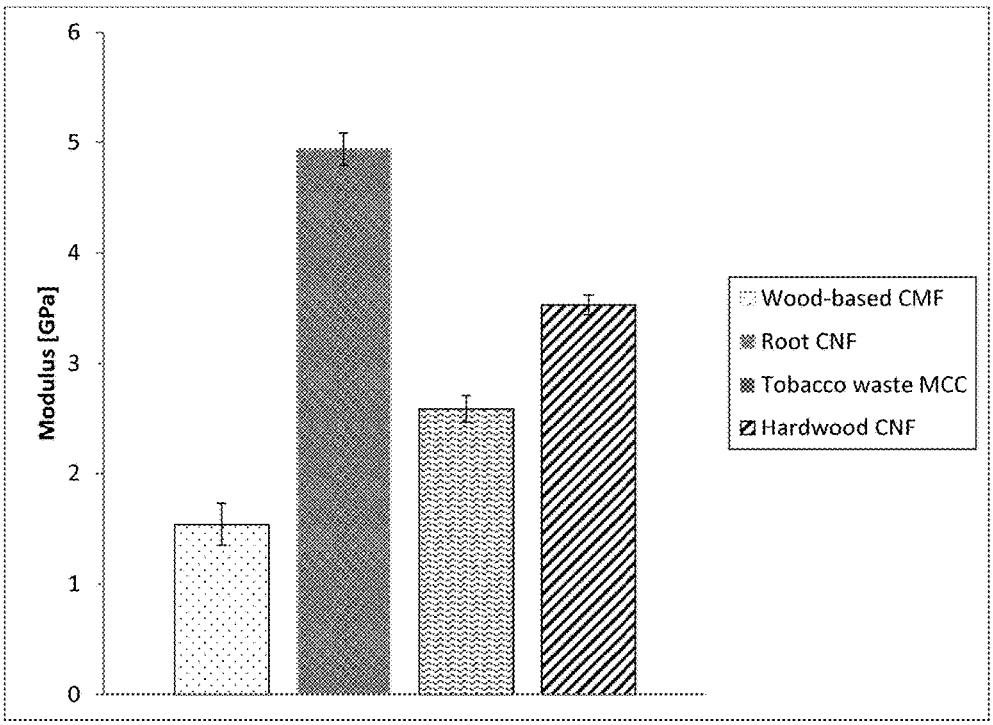
FIG. 7 is a graph showing the modulus of nanocellulose-based films from tobacco-derived materials and comparative wood-based materials.

Tensile properties of films are measured using a Lloyd-tensile tester with 100N load cell and compared to conventional wood-based materials and tobacco-derived microcrystalline cellulose materials. The testing method for the tensile properties were determined according to modified SCN P 38:80 Paper and board-Determination of tensile strength-procedure; Vartiainen et al. "Hydrophobization of cellophane and cellulose nanofibrils films by supercritical state carbon dioxide impregnation with walnut oil" Biorefinery, vol. 31 no. (4) 2016, which is hereby incorporated by reference in its entirety. Cross-head speed during test is 2 mm/min and the sample width is 15 mm. Gauge length is 20 mm. The results for a tobacco root based film (after five microfluidizer passes) are set forth in FIGS. 5-7. According to the illustrated results, the tobacco root CNF provides excellent tensile strength. The strength level is over 50% higher than tensile strength of the hardwood CNF produced by VTT Technical Research Centre of Finland Ltd. Both wood-based CMF and tobacco waste microcrystalline cellulose (MCC) exhibited very low levels of tensile strength. The strength of those samples was even lower than the strength of typical copier paper in the machine direction. Impurities in MCC probably caused the weakness in the film. However, it was cast in approximately 5% solids, which gives it a benefit in the drying phase considering energy consumption.

Basically no difference could be pointed out when comparing elongation values (strain) of the tobacco root CNF and the hardwood CNF. The tobacco waste MCC has relatively low strain partly due to crystalline structure. However, the result is affected by low tensile strength as the film was unable to tolerate higher strains. The wood-based CMF also performed relatively well, but was slightly inferior to the tobacco root CNF.

Modulus of the tobacco root CNF is acceptable and higher compared to the hardwood CNF. Despite the low quality film, the tobacco waste MCC was at a decent level as well.

Figure 8:
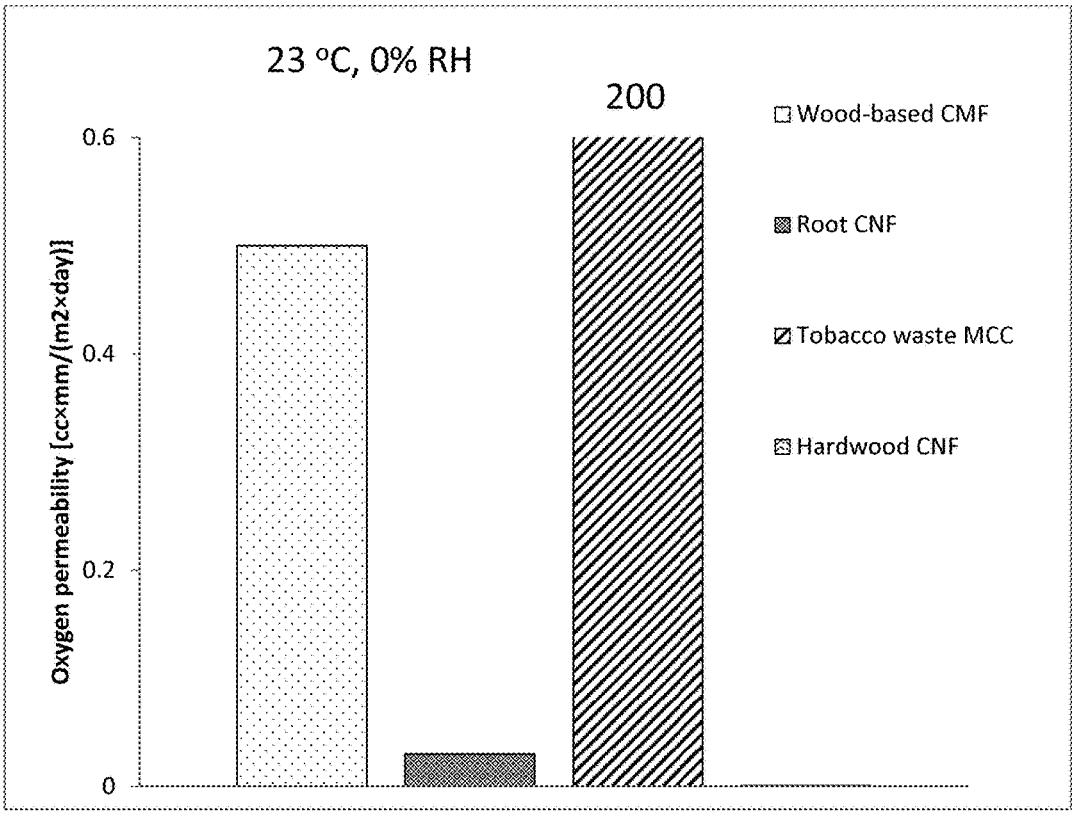
FIG. 8 is a graph showing the oxygen permeability of nanocellulose-based films from tobacco-derived materials and comparative wood-based materials at 23° C. and 0% RH.
Figure 9:
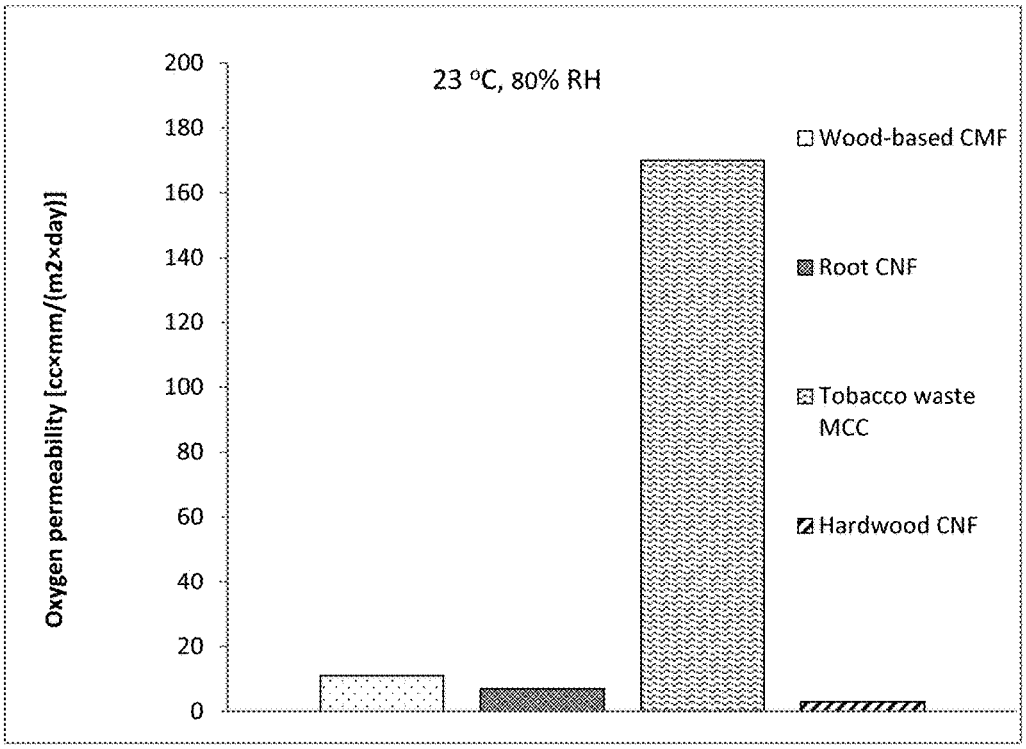
FIG. 9 is a graph showing the oxygen permeability of nanocellulose-based films from tobacco-derived materials and comparative wood-based materials at 23° C. and 80% RH.

Both the tobacco root CNF and the hardwood CNF have excellent oxygen barrier properties (FIGS. 8 and 9), which were measured by ASTM D3985; Vartiainen et al. "Hydrophobization of cellophane and cellulose nanofibrils films by supercritical state carbon dioxide impregnation with walnut oil" Biorefinery, vol. 31 no. (4) 2016, which is hereby incorporated by reference in its entirety. The MCC film has a high oxygen permeability and cannot be considered as an oxygen barrier film. Film made of the wood-based CMF is also comparable to other samples especially at high humidity. The lower mechanical properties of the wood-based CMF did not seem to affect oxygen barrier properties significantly.

Figure 10:
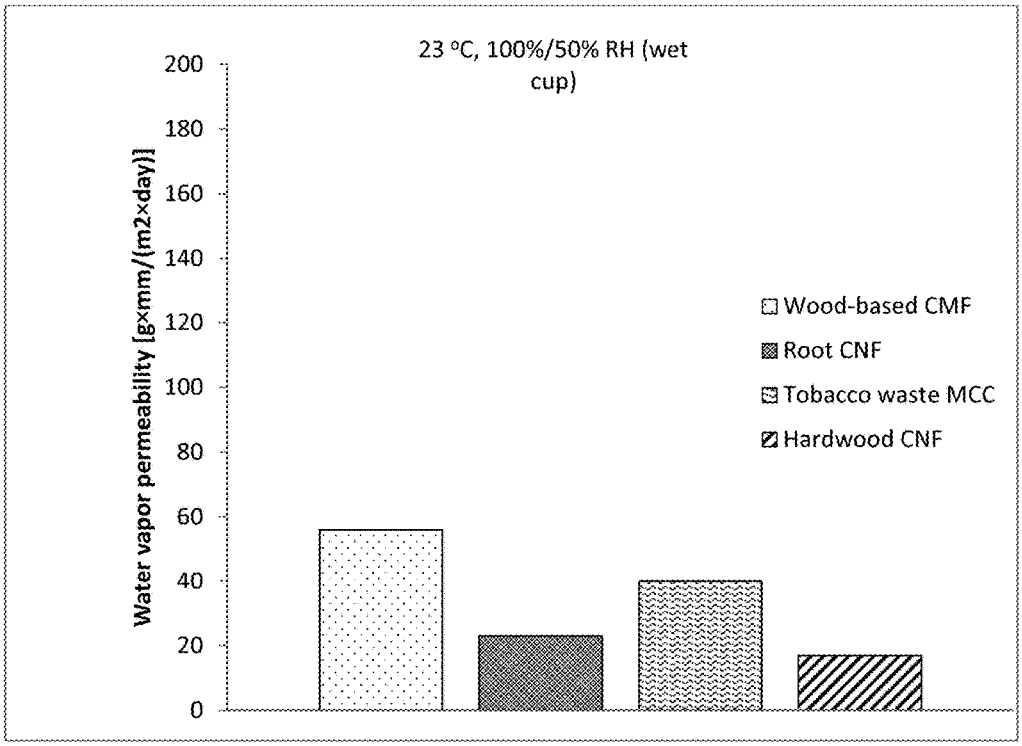
FIG. 10 is a graph showing the water vapor permeability of nanocellulose-based films from tobacco-derived materials and comparative wood-based materials using a wet cup method, wherein water (100%) is in the cup and 50% RH is outside the cup so that a moisture gradient is present in the measurement conditions.

In water vapour permeability measurements, which were determined gravimetrically using a modified ASTM-E-96B procedure "wet cup method; Vartiainen et al. "Hydrophobization of cellophane and cellulose nanofibrils films by supercritical state carbon dioxide impregnation with walnut oil" Biorefinery, vol. 31 no. (4) 2016, which is hereby incorporated by reference in its entirety. The sample films made from the tobacco root CNF and the hardwood CNF material are again the best samples. The tobacco waste MCC film is a better water vapour barrier than the wood-based CMF film (FIG. 10).

The films are also printed using silver ink and appropriate printers. The printed patterns were antennas and conductors. Antennas are printed using EKRA E2 screen and stencil printer. Printing paste was Asahi LS 411 AW. Curing is performed at 130° C. for 10 minutes. Print mesh is stainless steel SD 200, 87 wire/cm, wire diameter 40 μm and angle 22.5. Print layer thickness after curing is approximately 10 μm. Resistance levels of the antennas on these films are comparable with PET substrate.

Inkjet printed conductor wiring is done using PiXDRO LP50 on three film samples, the tobacco root based CNF (five passes through microfluidizer) and two comparative samples, the hardwood CNF referenced herein and the tobacco waste MCC referenced herein. Printhead is Konica Minolta KM512SHX with 4 picoliter nominal drop volume. Ink is ANP (Advanced Nano Products) DGP 40LT 15C silver nanoparticle ink. Print resolution was 720 dpi and the number of printed layers is two. Printing is performed on a smoother backside of the film substrates. Substrate table temperature was set to 60° C. Post-treatment is done with oven drying and oven sintering conditions are 30 min at 150° C. After sintering it is noticed that the film made of the tobacco root CNF did not change colour during sintering at 150° C. while the others became brownish. After sintering an LED lamp is attached manually to the printed object and its functioning was tested by attaching a battery to the conductor wires.

That which is claimed:

1. A method for preparing tobacco derived nanocellulose material comprising:

receiving a tobacco pulp in a dilute form such that the tobacco pulp is a tobacco pulp suspension with a consistency of less than about 5%; and mechanically fibrillating the tobacco pulp suspension to generate a tobacco derived nanocellulose material having at least one average particle size dimension in the range of about 1 nm to about 100 nm.

2. The method of claim 1, wherein the tobacco pulp is derived from tobacco root, tobacco stalk, tobacco fiber or a combination thereof.

3. The method of claim 1, wherein the tobacco derived nanocellulose material comprises cellulose microfibrils, cellulose nanofibrils, or cellulose nanocrystals.

4. The method of claim 1, wherein the tobacco derived nanocellulose material has an apparent viscosity of at least about 20,000 mPa*s at a consistency of 1.5%.

5. The method of claim 4, wherein the tobacco derived nanocellulose material has an apparent viscosity of at least about 25,000 mPa*s at a consistency of 1.5%.

6. The method of claim 1, wherein the mechanically fibrillating step comprises one or more of homogenization, microfluidization, grinding, and cryocrushing.

7. The method of claim 1, wherein the mechanically fibrillating step comprises passing the tobacco pulp suspension through a homogenizer or microfluidizer at elevated pressure of at least 100 bar.

8. The method of claim 7, wherein the elevated pressure is of at least 1000 bar.

9. The method of claim 7, wherein the tobacco pulp suspension passes through the homogenizer or microfluidizer no more than 5 passes.

10. The method of claim 9, wherein the tobacco pulp suspension passes through the homogenizer or microfluidizer no more than 3 passes.

11. The method of claim 10, wherein the tobacco pulp suspension passes through the homogenizer or microfluidizer in only one pass.

12. The method of claim 1, further comprising pretreating the tobacco pulp, either before or after formation of the tobacco pulp suspension, by subjecting the tobacco pulp to one or more mechanical, chemical or enzymatic treatment steps.

13. The method of claim 12, wherein the pre-treatment step is a mechanical grinding step.

14. The method of claim 12, wherein the pre-treatment step comprises a chemical treatment step selected from TEMPO oxidation, peroxide oxidation, carboxymethylation, acetylation, acid hydrolysis, and combinations thereof.

15. The method of claim 12, wherein the pre-treatment step comprises an enzymatic treatment selected from treatment with an endoglucanase, treatment with a hemicellulase, and combinations thereof.

16. A film formed of a tobacco-derived nanocellulose material having at least one average particle size dimension in the range of about 1 nm to about 100 nm, wherein the tobacco-derived nanocellulose material comprises cellulose nanofibrils having a surface modified by addition of hydrophobic, hydrophilic, or polar functional groups.

17. The film of claim 16, wherein the tobacco-derived nanocellulose material is derived from tobacco root, tobacco stalk, tobacco fiber or a combination thereof.

18. The film of claim 16, wherein the tensile strength of the film is greater than about 120 Mpa.

19. The film of claim 18, wherein the tensile strength of the film is greater than about 130 Mpa.

20. The film of claim 19, wherein the tensile strength of the film is or greater than about 140 Mpa.

21. The film of claim 16, having one or more of:

a. a strain of at least about 11%; and b. tensile modulus of at least about 4 Gpa.

22. The film of claim 16, wherein the oxygen permeability of the film is at least one of:

a. less than 0.2 cc×mm/$m^2$×day at a temperature of 23° C. and at a relative humidity (RH) of 0%; and b. less than about 20 cc×mm/$m^2$×day at a temperature of 23° C. and at a relative humidity (RH) of 80%.

23. The film of claim 16, wherein the water vapor permeability of the film is less than about 30 g×mm/$m^2$×day at a temperature of 23° C. and at a relative humidity (RH) of 50%.

24. The film of claim 16, wherein the tobacco-derived nanocellulose material is cellulose nanofibrils having a surface chemically modified by one or more of acetylation, silylation, oxidation, or carboxymethylation.

* * * * *